US012262835B2

(12) United States Patent
Kozak

(10) Patent No.: US 12,262,835 B2
(45) Date of Patent: Apr. 1, 2025

(54) MULTI-MODE SLEEPING BAG FOR CHILDREN

(71) Applicant: Julie Kozak, Pleasanton, CA (US)

(72) Inventor: Julie Kozak, Pleasanton, CA (US)

( * ) Notice: Subject to any disclaimer, the term of this patent is extended or adjusted under 35 U.S.C. 154(b) by 0 days.

(21) Appl. No.: 17/511,933

(22) Filed: Oct. 27, 2021

(65) Prior Publication Data

US 2023/0131670 A1 Apr. 27, 2023

(51) Int. Cl.
*A47G 9/08* (2006.01)
*A47D 15/00* (2006.01)

(52) U.S. Cl.
CPC ..... *A47G 9/083* (2013.01); *A47D 15/008* (2013.01)

(58) Field of Classification Search
CPC ..... A47G 9/083; A47D 15/008; A47D 9/04; A47D 9/08
See application file for complete search history.

(56) References Cited

U.S. PATENT DOCUMENTS 1,236,586 A * 8/1917 Milkes ..... A61F 13/64 604/397
2,651,781 A * 9/1953 Buchholz ..... A41B 13/06 2/69.5
4,575,876 A * 3/1986 Weaver ..... A41D 15/04 5/413 R
6,009,874 A * 1/2000 Sartin ..... A47D 5/00 5/655
6,266,822 B1 * 7/2001 Joyce ..... A47G 9/083 2/69.5
9,003,564 B2 * 4/2015 Wynh ..... A41B 13/06 2/83
2010/0242172 A1 * 9/2010 Lijesen ..... A47G 9/0246 5/413 R
2013/0312198 A1 * 11/2013 Kelly ..... A47D 5/00 5/655

* cited by examiner

*Primary Examiner* — Fredrick C Conley
(74) *Attorney, Agent, or Firm* — EAGLE IP LIMITED

(57) ABSTRACT

A sleeping bag comprising a bed sheet and a cover sheet secured together at a first end and at a portion of the sides to form a sleeping pocket. The bed sheet includes at least one of reversible pockets and a set of slits for securing the sleeping bag to a support. The cover sheet includes a reversible pocket at one end to secure the cover sheet in certain modes of operation. The sleeping bag further comprises a blanket sheet disposed between the bed sheet and a cover sheet to provide added comfort. The sleeping bag further comprises a holding member removably attached to at least one of the bed sheet and the cover sheet to support shoulders or lower body of a child such that the child is on the back while sleeping and the child is unable to slide entire body inside the sleeping pocket.

20 Claims, 19 Drawing Sheets

MULTI-MODE SLEEPING BAG FOR CHILDREN

TECHNICAL FIELD

The present disclosure relates generally to a sleeping assembly, such as sleeping bags, and more particularly to, a multi-mode secure sleeping bag for young children.

BACKGROUND

A sleeping bag (or bed roll) is a portable bedding complement for a person to sleep with or without a bed. Sleeping bags typically include relatively thick upper and lower panels that provide necessary warmth as well as padding for comfort. Typically, sleeping bags also are constructed with a zipper for opening or closing the sleeping bag for improving insulation.

Traditional sleeping bags are designed for adults and older children, and may not be suitable for younger children or babies. For example, the sleeping bag may contain small articles or loose flaps that might be hazardous for a small child. Thus, prior art sleeping bags have not been specifically structured to enhance comfort and security, especially for young children. Further, a major problem that has been experienced is the sudden unexpected death in infancy (SUDI), sudden infant death syndrome (SIDS), and fatal sleeping accidents. Research states that this risk can be minimized if the children sleep on their back instead of sides or stomach. Therefore, some safe sleeping practices for babies or infants include that the babies should always be on their back while sleeping and no bumper pads or pillows should be used. Conventional sleeping bags provide padding or pillows to restrict sleeping position, but are not suitable for young children or babies for the aforementioned reasons.

Thus, there is a need for sleeping bags for younger children or babies that overcome the aforementioned problems of conventional sleeping bags.

SUMMARY

The present disclosure relates to secure sleeping bags for young children, keeping any child warm and blanket secure, together with carrier portability. The present sleeping bag is attached as one unit, providing convenient carrying, storage, and placement. The present sleeping bag may have pad pockets for keeping bedding secure in portable cribs or playpens. The present sleeping bag may have safety pockets for eliminating loose ends, keeping children safe for example, from blanket being over their head. Further, the present sleeping bag has a detachable safety member that holds the child in a specific position such that the child is always on the back while sleeping and eliminates risk of suffocation due to entire body of the child sliding inside the sleeping bag.

In an embodiment of the present disclosure, a sleeping bag is disclosed. The sleeping bag comprises a bed sheet, a blanket sheet, and a cover sheet attached to each other at a first end and optionally at a portion of two sides adjacent to the first end, and freed at a second end opposite to the first end to form a first sleeping pocket between the bed sheet and the blanket sheet and a second sleeping pocket between the blanket sheet and the cover sheet. The bed sheet comprises at least one of a plurality of reversible pockets and a set of slits for securing the sleeping bag to a support. The cover sheet comprises a reversible pocket at the second end to secure the cover sheet in certain modes of operation. The sleeping bag further comprises a holding member removably attached to the bed sheet and one of the blanket sheet and the cover sheet, wherein the holding member forms openings for a head and hands of a child sleeping in one of the first and second sleeping pockets, to support shoulders of the child such that the child is on the back while sleeping and the child is unable to slide entire body inside one of the first and second sleeping pockets. The sleeping bag also forms a secure blanket configuration to prevent loss of blanket coverage due to the movement of the child.

In some examples, the holding member comprises first and second hand covers to receive hands of the child sleeping in one of the first and second sleeping pockets, to provide comfort and warmth to the hands of the child.

In some examples, an upper surface of the cover sheet comprises a set of securing pockets such that a length of the sleeping bag is adjusted by folding the sleeping bag from the first end at a corresponding securing pocket of the set of securing pockets, and securing the sleeping bag to the support by way of the corresponding securing pocket and the second reversible pocket. Thus, the length of the sleeping bag is adjustable to a height of the child.

In some examples, when the support is a support pad or mattress of a crib, the sleeping bag is secured to the support pad or the mattress by way of the plurality of reversible pockets, and when the support is a harness of a movable object, such as a seat of a moving vehicle or a stroller, the sleeping bag is secured to the harness by way of the set of slits.\

In another embodiment of the present disclosure, a sleeping bag is disclosed. The sleeping bag comprises a bed sheet, a blanket sheet, and a cover sheet attached to each other at a first end and optionally at a portion of two sides adjacent to the first end, and freed at a second end opposite to the first end to form a first sleeping pocket between the bed sheet and the blanket sheet and a second sleeping pocket between the blanket sheet and the cover sheet. The bed sheet comprises at least one of a plurality of reversible pockets and a set of slits for securing the sleeping bag to a support. The cover sheet comprises a reversible pocket at the second end to secure the cover sheet in certain modes of operation. The sleeping bag further comprises a holding member removably attached to one of the bed sheet and the blanket sheet, wherein the holding member forms openings for upper body and legs of a child sleeping in one of the first and second sleeping pockets, to support a lower body of the child such that the child is on the back while sleeping and the child is unable to slide entire body inside one of the first and second sleeping pockets. The sleeping bag also forms a secure blanket configuration to prevent loss of blanket coverage due to the movement of the child.

In yet another embodiment of the present disclosure, a multi-mode sleeping bag is disclosed. The multi-mode sleeping bag comprises at least a bed sheet and a cover sheet attached to each other at a first end and a portion of two sides adjacent to the first end, and freed at a second end opposite to the first end to form a sleeping pocket between the bed sheet and the cover sheet. The bed sheet comprises first and second reversible pockets at the first and second ends, respectively, and the cover sheet comprising a third reversible pocket at the second end that has substantially similar dimensions as the second reversible pocket to allow overlapping of the second reversible pocket by the third reversible pocket in a reversible configuration to secure the cover sheet to the bed sheet. The sleeping bag functions as a multi-mode convertible sleeping bag. For example, a first mode has the sleeping bag placed on a surface, functioning as a sleeping bag. The sleeping bag can be laid directly on a surface, or can be secured to a pad through the reversible pad pockets to provide added support. A second mode has the reversible cover pocket covering the bed sheet and the reversible pad pocket at the second end, with or without a bed pad, functioning as a mattress with no loose flap. A third mode has the cover sheet folded over and the reversible cover pocket covering the bed sheet and the reversible pad pocket at the first end, with or without a bed pad, functioning as a mattress with no loose flap. A fourth mode has the cover sheet and the bed sheet folded over and the reversible pad pocket at the second end covering the bed sheet and the reversible pad pocket at the first end, functioning as a half-size mattress with no loose flap. A fifth mode has the cover sheet and the bed sheet folded twice over and the reversible pad pocket at the second end covering the bed sheet and the reversible pad pocket at the first end, readying for storage. The multi-mode sleeping bag further comprises a holding member attached to at least one of the bed sheet and the cover sheet to hold a child sleeping in the sleeping pocket such that the child is on the back while sleeping and the child is unable to slide entire body inside the first sleeping pocket.

In some examples, the multi-mode sleeping bag can be used as a blanket or comforter. For example, the sleeping bag has slits in the middle to accommodate harness for a stroller or a vehicle seat, functioning as a blanket for the child sitting in the stroller or the vehicle seat with fastened seat belts.

BRIEF DESCRIPTION OF THE DRAWINGS

The illustrated embodiments of the subject matter will be best understood by reference to the drawings, wherein like parts are designated by like numerals throughout. The following description is intended only by way of example, and simply illustrates certain selected embodiments of devices, systems, and processes that are consistent with the subject matter as claimed herein.

DETAILED DESCRIPTION

Figure 1A:
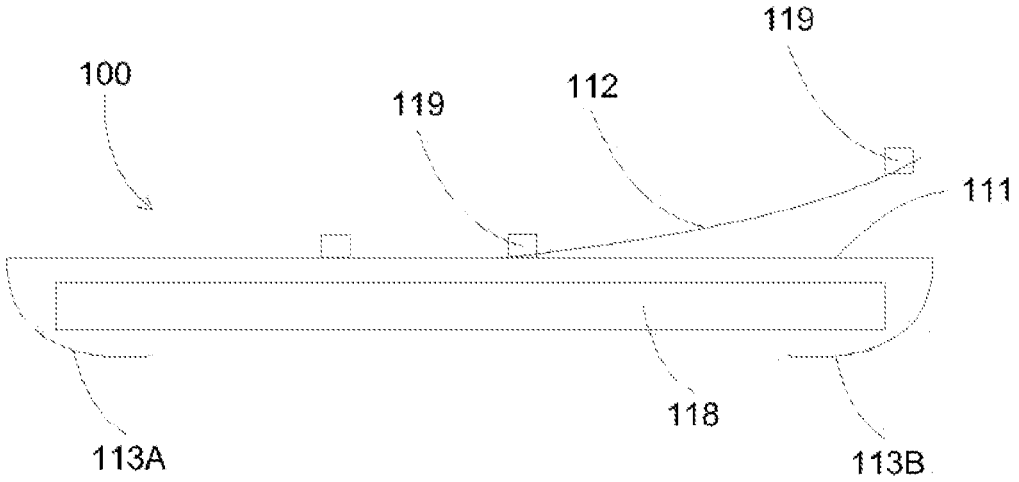
FIGS. 1A and 1B illustrate a perspective view and a cross section view of a sleeping bag according to an embodiment of the present disclosure.

Example apparatus are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The present disclosure relates to a sleeping bag, and more particularly, to a portable and secured sleeping bag especially adapted for children, which can easily be transformed into different modes of operation. The present sleeping bag can secure a child or an infant on a sleep surface such as on a floor or on a crib or bed. The present sleeping bag is portable and washable, thus is particularly suited for use in public places, such as a daycare center, where children can provide their own sleeping bags, or the center can provide sanitary sleeping bags for its clients without cross contamination. The present sleeping bag can be used directly on a floor surface, or can be secured to a pad or mat to provide added comfort. The sleeping bags and pads can be stacked within a daycare room, and distributed at nap time. The sleeping bags can be washed between usages. The sleeping bag is designed for security, especially for young children or infants, for example, in the form of no loose flaps, or no strings or small components, and holding member to support body of the young children or infants to always be on back while sleeping and preventing entire body of the child to slide inside the sleeping bag. In an embodiment, the present sleeping bag provides an infant's sleeping environment as free as possible of suffocation hazards while at the same time ensuring the infant is kept in a secure sleeping position.

In an embodiment, the present disclosure discloses a sleeping bag for use as a bedding complement for a young child or an infant that provides comfort, washability and security, especially for young children. The present sleeping bag can include a cover sheet and/or a blanket sheet to provide additional warmth. In addition, the present sleeping bag is portable, easily stored, and can be easily and quickly arranged for children sleeping.

In an embodiment, the present disclosure discloses a sleeping bag with attachable components to a solid support with essentially similar dimension, such as a pad or a mattress of a crib, to hold the sleeping bag in place, to prevent shifting of the sleeping bag, and to ensure that the child has adequate blanket coverage without exposure to the ambient, for example, due to the movement of the child.

In an embodiment, the present disclosure discloses a sleeping bag with attachable holding members to support the body of the child such that the child is always on the back while sleeping.

Figure 1B:
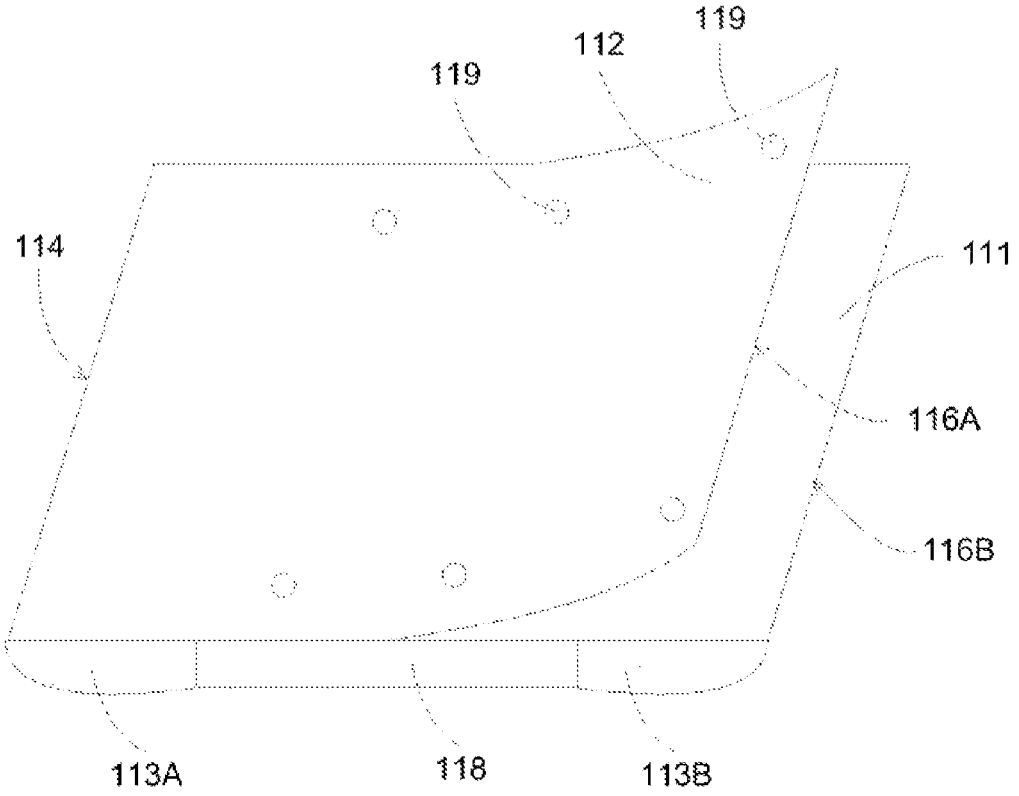

FIGS. 1A and 1B illustrate a sleeping bag 100 according to an embodiment of the present disclosure, attached to a pad 118 of substantially similar dimension. The sleeping bag 100 comprises a bed sheet 111 and a cover sheet 112, attached together at a first end 114 and a portion of two sides adjacent to the first end 114. The bed sheet 111 and the cover sheet 112 are free at second ends 116A and 116B, respectively, opposite to the first end 114. The bed sheet 111 and the cover sheet 112 thus form a sleeping pocket. The cover sheet 112 can optionally comprise a plurality of connection mechanisms 119, such as snap buttons, hooks, Velcro or other methods of attachment, to secure the free end of the cover sheet 112 to the bed sheet 111. The bed sheet 111 comprises a plurality of attachments 113A and 113B for securing the sleeping bag 100 to a support, such as the pad 118, i.e., a solid support, or a harness of a movable object. The attachments 113A and 113B on the bed sheet 111 may comprise various configurations, such as pocket configurations for easily attaching to the pad 118. In one embodiment, the attachments 113A and 113B are at least one of a plurality of reversible pockets and a set of slits for securing the sleeping bag 100 to the support. The plurality of reversible pockets include first and second reversible pockets 113A and 113B attached at the first and second ends 114 and 116B of the bed sheet 111, respectively.

Figure 1C:
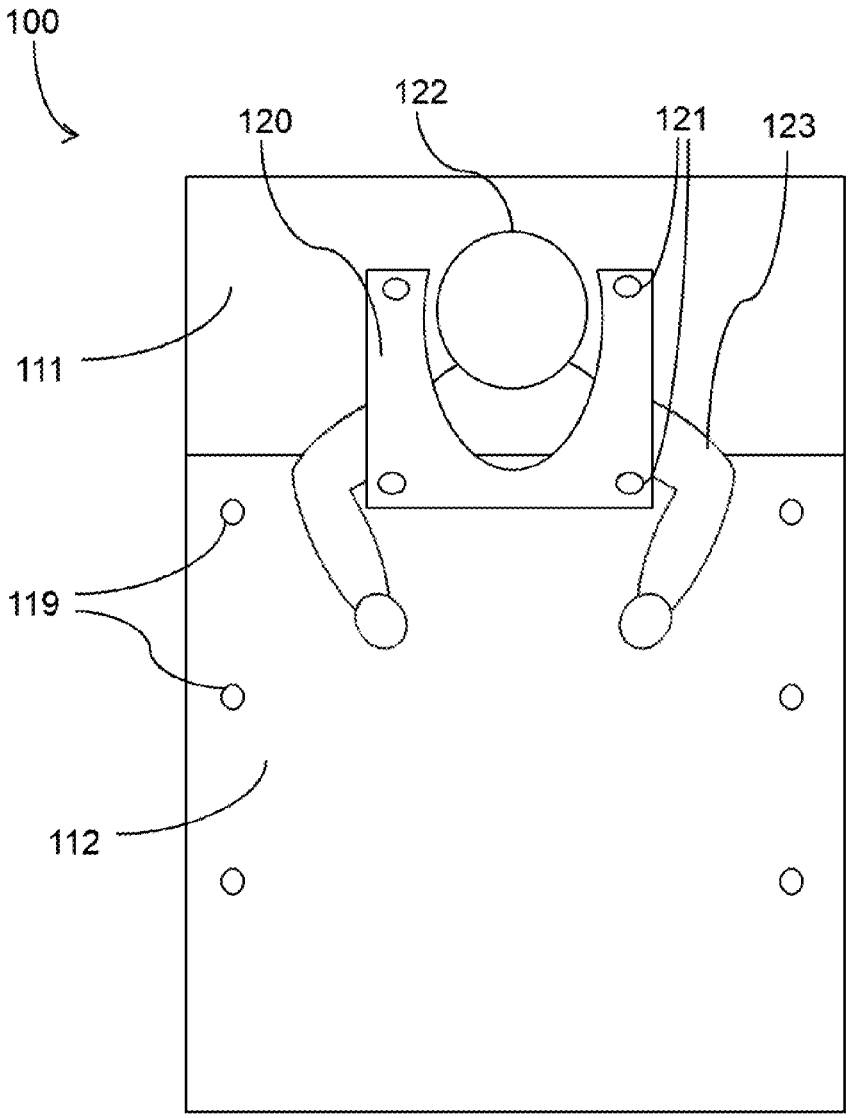
FIGS. 1C-1E illustrate a top view of the sleeping bag with different holding member configurations according to embodiments of the present disclosure.
Figure 1D:
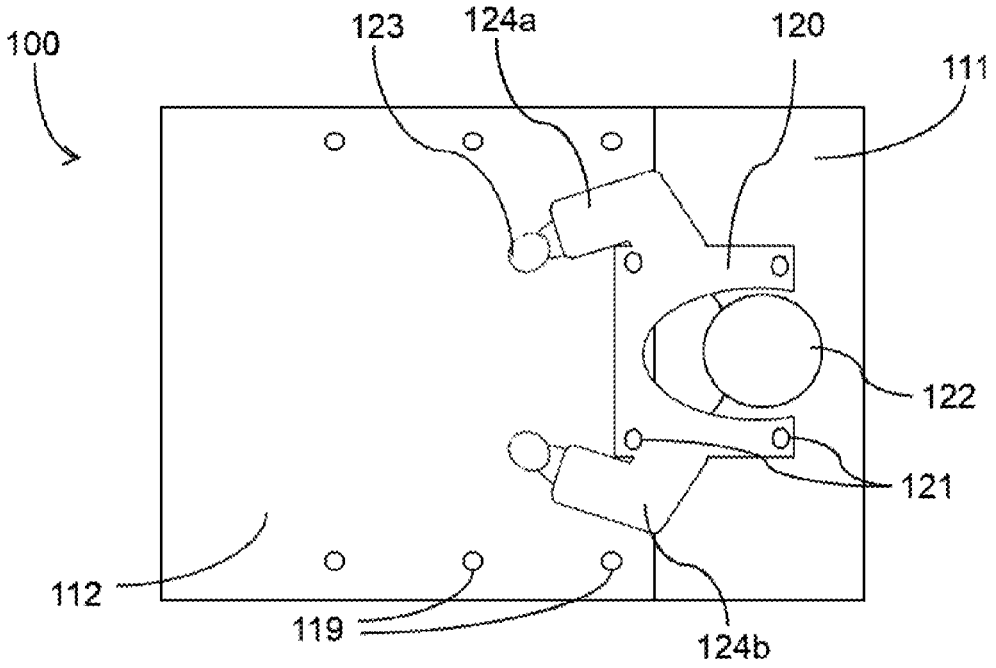
Figure 1E:
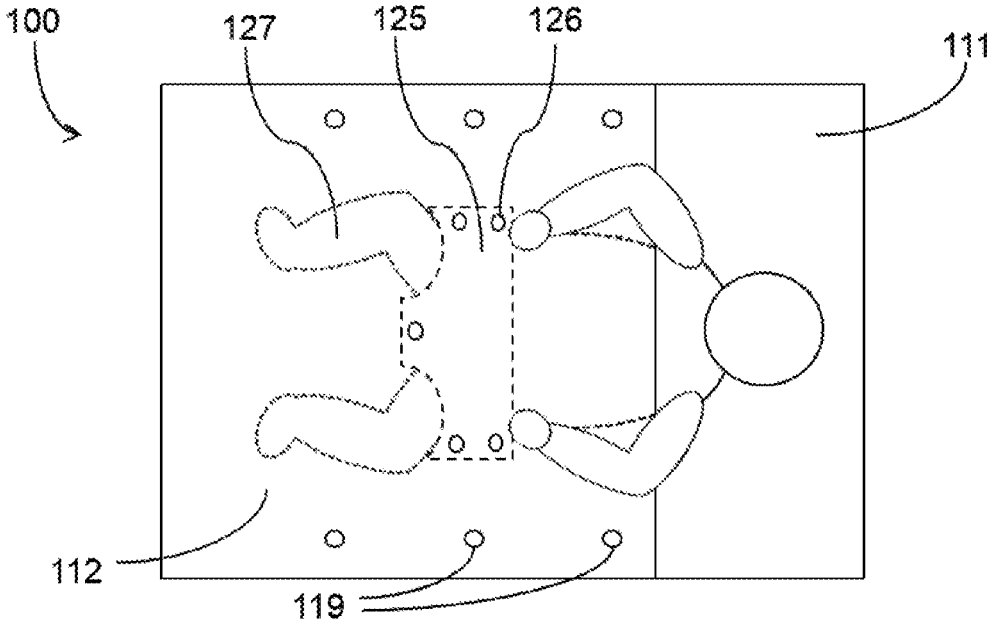

FIGS. 1C-1E illustrate a top view of the sleeping bag with different holding member configurations according to embodiments of the present disclosure. Referring now to FIG. 1C, in this embodiment, the sleeping bag 100 includes a holding member 120 removably attached to the bed sheet 111 and the cover sheet 112. In one embodiment, the holding member 120 is removably attached to the bed sheet 111 and the cover sheet 112 by way of a plurality of attaching elements 121. Examples of the plurality of attaching elements 121 are, but not limited to, buttons, click or snap buttons, or Velcro. In the present embodiment, the holding member 120 is attached to an upper surface of the bed sheet 111 and an upper surface of the cover sheet 112. However, the scope of the present disclosure is not limited to it and in various other embodiments, the holding member 120 is attached to the upper surface of the bed sheet 111 and an inner surface of the cover sheet 112, without deviating from a scope of the present disclosure.

The holding member 120 forms openings for a head 122 and hands 123 of a child sleeping in the sleeping pocket, to support shoulders of the child such that the child is always on the back while sleeping and the child is unable to slide entire body inside the sleeping pocket. Thus, the holding member 120 prevents the child to sleep in any position other than on the back position, such as on the side or on the stomach, and prevents any chances of suffocation by entirely sliding inside the sleeping pocket, to avoid risks related to sudden infant death syndrome (SIDS) or avoid any fatal sleeping accidents.

Referring now to FIG. 1D, in this embodiment, the holding member 120 includes comprises first and second hand covers 124*a* and 124*b* to receive the hands 123 of the child sleeping in the sleeping pocket. The first and second hand covers 124*a* and 124*b* provide comfort and warmth to the hands 123 of the child.

Referring now to FIG. 1E, in this embodiment, the sleeping bag 100 includes a holding member 125 removably attached to the bed sheet 111. In one embodiment, the holding member 125 is removably attached to the bed sheet 111 by way of a plurality of attaching elements 126. Examples of the plurality of attaching elements 126 are, but not limited to, buttons, click or snap buttons, or Velcro. In the present embodiment, the holding member 125 is attached to the upper surface of the bed sheet 111. The holding member 125 forms openings for upper body and legs 127 of the child sleeping in the sleeping pocket, to support a lower body of the child such that the child is always on the back while sleeping and the child is unable to slide entire body inside the sleeping pocket. Thus, the holding member 125 prevents the child to sleep in any position other than on the back position, such as on the side or on the front, and prevents any chances of suffocation by entirely sliding inside the sleeping pocket, to avoid risks related to SIDS or avoid any fatal sleeping accidents.

It will be apparent to a person skilled in the art that as the holding members 120 and 125 are removably attached to the sleeping bag 100, the sleeping bag 100 may be used with or without the holding members 120 and 125 as per the requirement. For example, when the sleeping bag 100 is to be used for small babies (aged between 0-1 years), the holding members 120 and 125 may be used for added security for small babies, and when the sleeping bag 100 is to be used for young children (aged greater than 1 year), the holding members 120 and 125 may not be used.

In one embodiment, the holding member 12, the holding member 120 with the first and second hand covers 124A and 124B, and the holding member 125 may be made, but not limited to, using same material as the cover sheet 111.

Figure 2A:
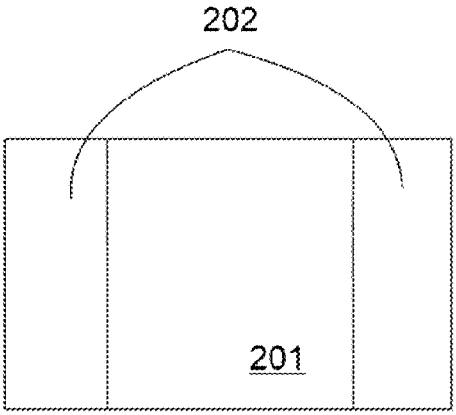
FIGS. 2A-2D illustrate different pocket configurations of the bed sheet according to embodiments of the present disclosure.
Figure 2B:
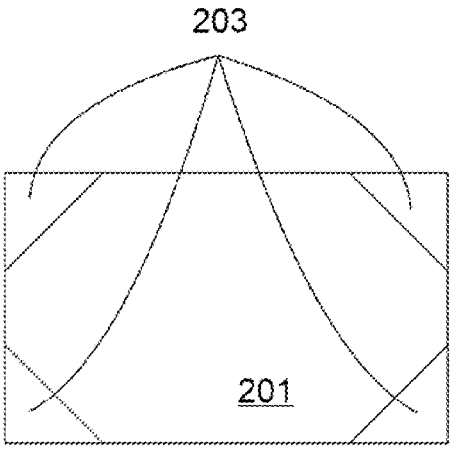
Figure 2C:
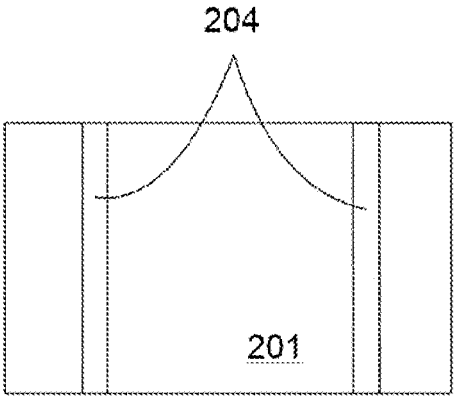
Figure 2D:
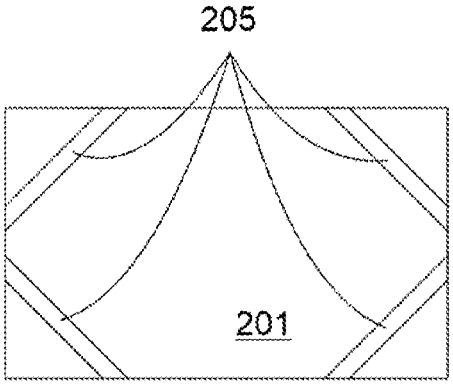

FIGS. 2A-2D illustrate different pocket configurations of the bed sheet 111, showing a back side 201 of the bed sheet 111. In FIG. 2A, panels 202 are attached to the bed sheet 111 at one end, such as the first end 114 and the second end 116A, and a portion of sides adjacent to the one end, forming pockets with openings for accepting the support, such as the pad 118. In one embodiment, the pockets formed by the panels 202 are reversible pockets. In FIG. 2B, panels 203 are attached to the bed sheet 111 at corners, i.e., portions of two sides adjacent to each other, forming pockets with openings for accepting the support, such as the pad 118. In one embodiment, the pockets formed by the panels 203 are reversible pockets. In FIG. 2C, strip panels 204 are attached to the bed sheet 111 crossing two opposite ends, forming strips with openings for accepting the support, such as the pad 118. In one embodiment, the strips formed by the strip panels 204 are reversible strips. In FIG. 2D, strip panels 205 are attached to the bed sheet 111 crossing corners, forming strips with openings for accepting the support, such as the pad 118. In one embodiment, the strips formed by the strip panels 205 are reversible strips.

Figure 3A:
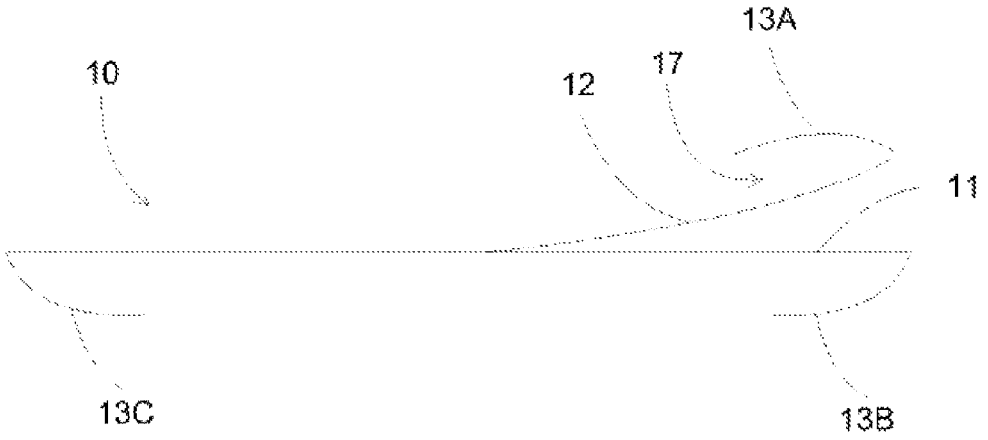
FIGS. 3A and 3B illustrate a perspective view and a cross section view of another sleeping bag according to an embodiment of the present disclosure.
Figure 3B:
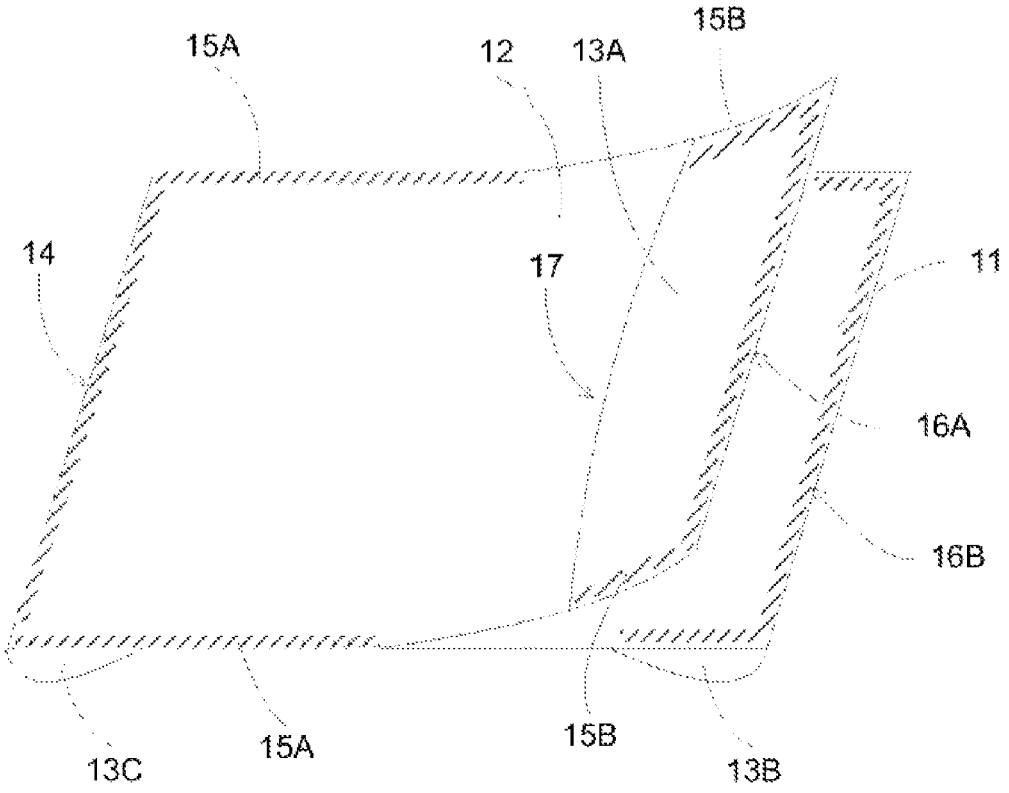

The present sleeping bag may comprise pockets at the cover sheet to function in multiple modes. In an embodiment, a sleeping bag is provided that includes a bed sheet and a cover sheet sewn together to form a sleeping pocket. Reversible pockets are provided on the bed sheet and optionally in the cover sheet for added security and functionality. FIGS. 3A and 3B illustrate a perspective view and a cross section view of a sleeping bag 10 according to an embodiment of the present disclosure. The sleeping bag 10 includes a bed sheet 11, a cover sheet 12, and pockets 13A, 13B and 13C. The bed sheet 11 and the cover sheet 12 are secured together, for example by sewing, at a first end 14 and a portion of sides 15A adjacent to the first end 14 to form a sleeping pocket. The cover sheet 12 includes the pocket 13A (hereinafter also referred to as the cover pocket 13A) at a second end 16A, opposite to the first end 14. The cover pocket 13A is a reversible pocket and is formed by sewing a pocket panel to the cover sheet 12 along the second end 16A and a portion of the sides 15B adjacent to the second end 16A to form a pocket opening 17 facing an outer surface of the cover sheet 12. The cover pocket 13A is reversible, i.e., the cover pocket 13A may be turned inside out such that the pocket opening 17 is facing the bed sheet 11. In an embodiment, the cover pocket 13A, after being reversed, may be used to cover the bed sheet 11 to form an integrated layer of bedding. The bed sheet 11 comprises the two pockets 13C and 13B (hereinafter also known as the pad pockets 13B and 13C) at the first end 14 and a second end 16B, opposite to the first end 14, respectively, with at least one pad pocket being reversible, for example, the pad pocket 13B. The pad pockets 13B and 13C are designed to securely attach to a pad or mat (not shown), for example, to provide a thicker layer of bedding for added comfort. In addition, the pad pocket 13B may be reversible to provide additional functionality, such as tucking to the cover sheet 12 or to the first end 14 of the bed sheet after the sleeping bag 10 is folded in half. The pad pockets 13B and 13C may be constructed in a manner similar to the construction of the cover pocket 13A, e.g., sewing along the end and a portion of the sides of the bed sheet 11.

Alternatively, other configurations for attaching the bed sheet 11 to a pad or mattress may be used in place of the pad pocket 13B and 13C, such as corner pad pockets, strip panels, or corner strip panels. Also, the reversible cover pocket 13A on the cover sheet 12 is optional, and is designed for providing multi-mode operations of the sleeping bag 10.

The bed sheet 11 may be made of a cloth material, such as soft, light weight cotton, other absorbent material, polyester, wool, or fleece, water repellent or resistant materials or natural and synthetic textiles. Alternatively, the bed sheet 11 may be filled with a soft, resilient filler material to provide additional padding. The cover sheet 12 may be made from thicker fabric material with optional fillers, such as a comforter or quilt. For ease of washing, the cover sheet 12 comprising a quilted sheet is preferred. In an embodiment, the bed sheet 11 and the cover sheet 12 are joined together to form side and bottom seams, which may be sewn seams or other fabric joining techniques known in the art. Any known stitching pattern may be used to join the fabrics, and continuous or intermediate stitching may be used. Additional stitching may be provided across the sheet, such as the cover sheet 12, to stabilize the filler to prevent potential settling or slippage of the padding material. The pockets 13A, 13B, and 13C maybe formed by folding the bed sheet 11 or the cover sheet 12 before joining three outer sides.

In an embodiment, the sleeping bag 10 is solidly constructed, for example, all elements are fabric, so that no small, hard objects may come loose and pose a potential hazard for the child. In addition, there may be no loose flaps or cords, a feature that provides added security for small children (infants). The present sleeping bag 10 may have multiple purposes, and may be easily transportable. In addition, the present sleeping bag 10 may be quickly removed for laundering, allowing for more versatility and usability, especially in the arenas that involve the care of multiple children, such as hospitals, daycare centers or hotels.

The sleeping pocket is between half to ¾ of the length of the sleeping bag 10. The pockets 13A, 13B, and 13C may have elastic straps or stretchable portions to allow accommodation of variations in pads or mats. The stretchable portion may be cut from a suitable stretchable fabric such as, but not limited to, nylon tricot. The stretchable portion may be part stretchable and part non-stretchable. In either case, the stretching portion may have means for limiting its stretch. A length of the sleeping bag 10 is designed to accommodate a length of the child, such as from newborns to about 4-6 year old. Alternatively, the length of the sleeping bag 10 is designed to fit the standard pads or mats, which are approximately six (6) to eight (8) feet. A width of sleeping bag is approximately 2 to 3 feet. The pockets 13A, 13B, and 13C are between 6 to 12 inches deep.

Figure 3C:
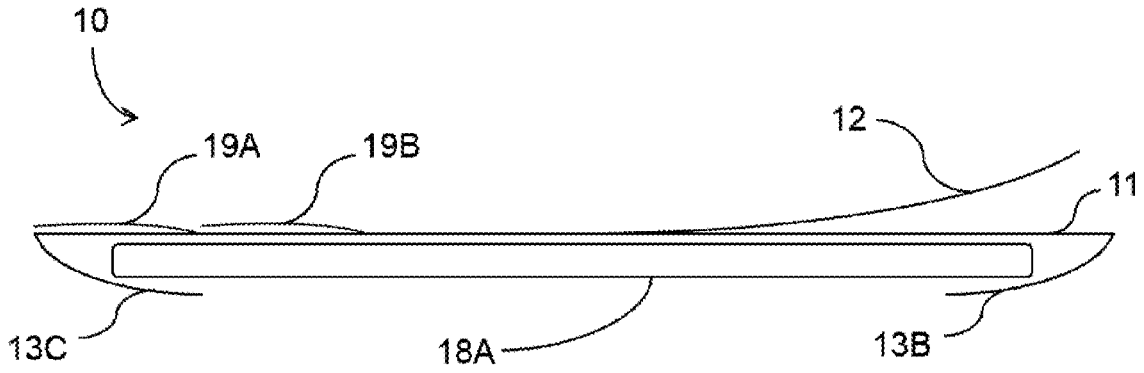
FIGS. 3C-3E illustrate a cross section view of folding configuration of the sleeping bag according to an embodiment of the present disclosure.
Figure 3D:
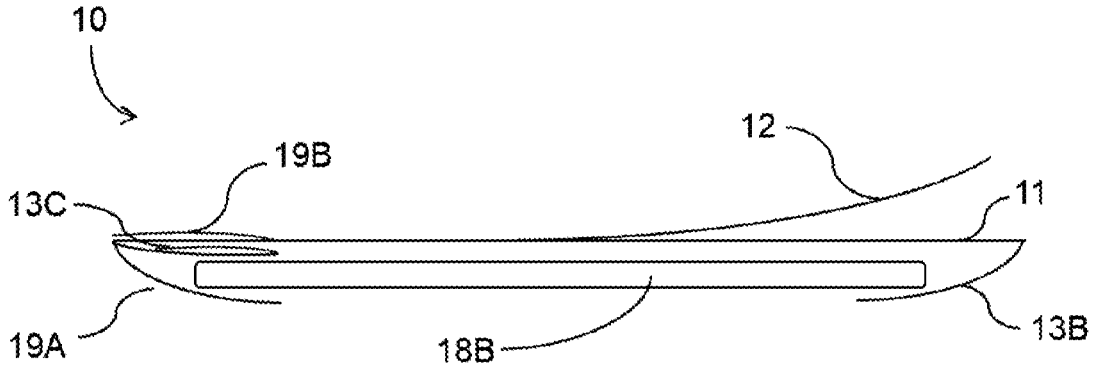
Figure 3E:
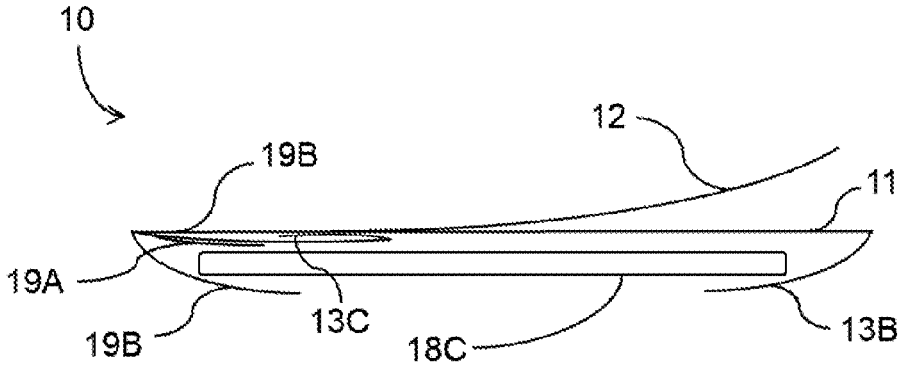

FIGS. 3C-3E illustrate a cross section view of folding configuration of the sleeping bag 10 according to an embodiment of the present disclosure. Referring now to FIG. 3C, the sleeping bag 10 is secured to a support 18A, such as a pad or mattress of a crib, by way of the pad pockets 13B and 13C. An upper surface of the cover sheet 12 includes a set of securing pockets, such as first and second securing pockets 19A and 19B. A length of the sleeping bag 10 is adjusted by folding the sleeping bag 10 from a first end, i.e., the end at which the pad pocket 13C is attached, at a corresponding securing pocket of the set of securing pockets, and securing the sleeping bag 10 to the support 18A by way of the corresponding securing pocket and the pad pocket 13B.

Referring now to FIG. 3D, the sleeping bag 10 needs to be secured a support 18B which has a length less than the support 18A. The length of the sleeping bag 10 is adjusted to the length of the support 18B by folding the sleeping bag 10 from the first end at an edge of the first securing pocket 19A. Further, the sleeping bag 10 is secured to the support 18B by way of the first securing pocket 19A and the pad pocket 13B as shown in FIG. 3D.

Referring now to FIG. 3E, the sleeping bag 10 needs to be secured a support 18C which has a length less than the support 18B. The length of the sleeping bag 10 is further adjusted to the length of the support 18C by folding the sleeping bag 10 from the first end at an edge of the second securing pocket 19B. Further, the sleeping bag 10 is secured to the support 18C by way of the second securing pocket 19B and the pad pocket 13B as shown in FIG. 3E.

It will be apparent to a person skilled in the art that although in the current embodiment, the cover sheet 12 includes the first and second securing pockets 19A and 19B for adjusting the length of the sleeping bag 10, the scope of the present disclosure is not limited to it. In various other embodiments, the cover sheet 12 may include any number of securing pockets to adjust the length of the sleeping bag 10, without deviating from the scope of the present disclosure.

It will be further apparent to a person skilled in the art that although in the current embodiment, the length of the sleeping bag 10 is adjusted by using the first and second securing pockets 19A and 19B, the scope of the present disclosure is not limited to it. In various other embodiments, the length of the sleeping bag 10 may be adjusted by utilizing any know techniques for length adjustments, such as, strings, zippers, or the like, without deviating from the scope of the present disclosure.

In an embodiment, the present sleeping bag further comprises a blanket sheet, either disposed between the cover sheet and the bed sheet, or disposed outside the cover sheet. In addition, in some cases, the blanket sheet can include a blanket reversible pocket at the second end opposite to the first end. The blanket sheet can provide additional support and comfort for a child when sleeping. In an embodiment, fabrication processes for the sleeping bag with the blanket sheet is similar to those of the sleeping bag without the blanket sheet.

Figure 4A:
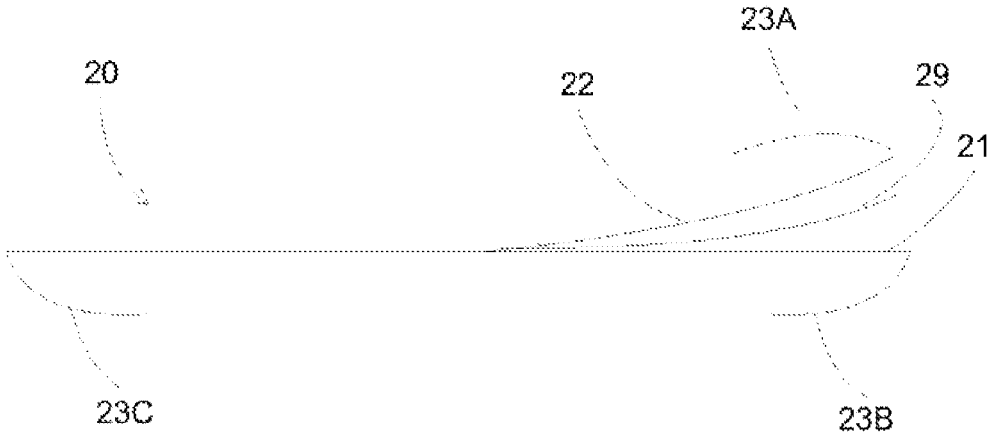
FIGS. 4A and 4B illustrate a perspective view and a cross section view of another sleeping bag according to an embodiment of the present disclosure.
Figure 4B:
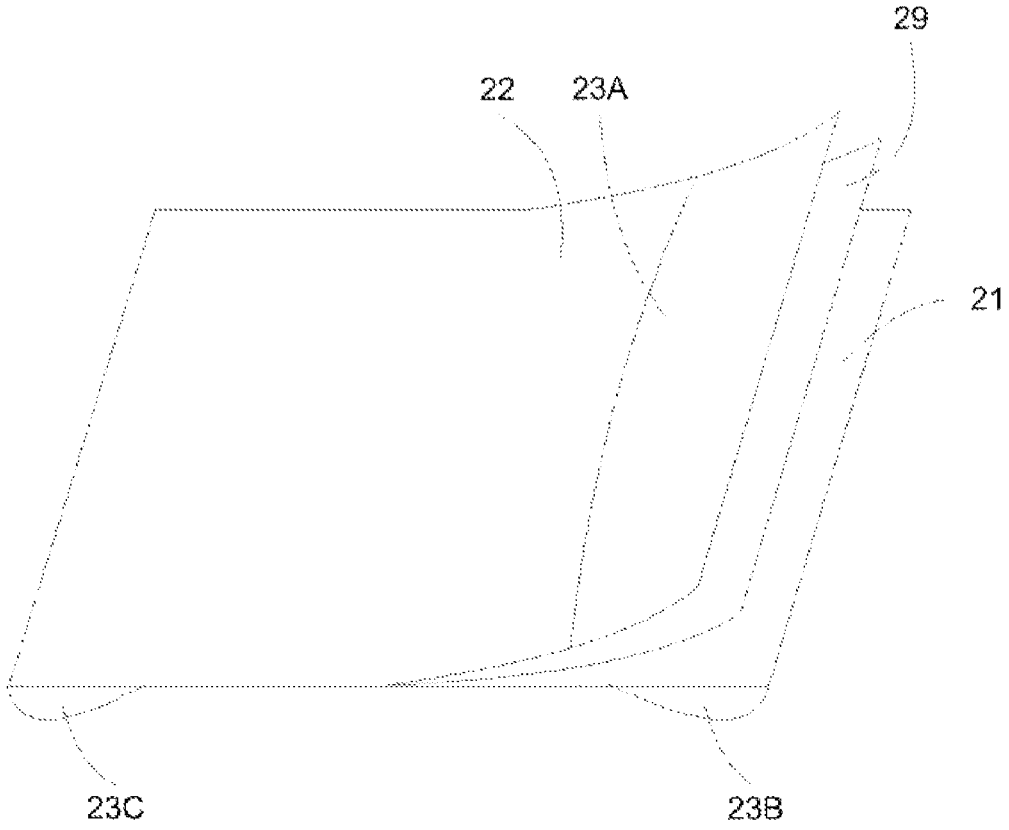

FIGS. 4A and 4B illustrate a perspective view and a cross section view of another exemplary sleeping bag 20 according to an embodiment of the present disclosure. The sleeping bag 20 includes a bed sheet 21, a blanket sheet 29, a cover sheet 22, and reversible pockets 23A, 23B and 23C. The blanket sheet 29 is disposed between the cover sheet 22 and the bed sheet 21, and is made of soft and warm material for added heat retention for the sleeping bag 20. The bed sheet 21, the blanket sheet 29, and the cover sheet 22 are attached together at a first end and a portion of two sides adjacent to the first end. The bed sheet 21 and the cover sheet 22 are free at second ends opposite to the first end, similar to the configuration of the bedsheet 111 and the cover sheet 112 described in FIG. 1A. Thus, two sleeping pockets are formed such that a first sleeping pocket is formed between the bed sheet 21 and the blanket sheet 29, and a second sleeping pocket is formed between the blanket sheet 29 and the cover sheet 22. In one embodiment, the first and second sleeping pockets have similar configurations, i.e., the first and second sleeping pockets are of same size. As shown, the three sheets 21, 29 and 22 are joined together at the same locations, but in other embodiments, the three sheets can be joined at arbitrary locations, for example, the first sleeping pocket formed by the bed sheet 21 and the blanket sheet 29 can be deeper than the second sleeping pocket formed by the blanket sheet 29 and the cover sheet 22.

In one embodiment, when the child is sleeping in the first sleeping pocket, the holding member 120 may be removably attached to the bed sheet 21 and one of the blanket sheet 29 and the cover sheet 22 in a manner similar to the attachment of the holding member 120 to the bed sheet 111 and the cover sheet 112 as described in FIG. 1C. When the child is sleeping in the second sleeping pocket, the holding member 120 may be removably attached to the bed sheet 21 and the cover sheet 22. In another embodiment, when the child is sleeping in the first sleeping pocket, the holding member 125 may be removably attached to the bed sheet 21 in a manner similar to the attachment of the holding member 125 to the bed sheet 111 as described in FIG. 1E. When the child is sleeping in the second sleeping pocket, the holding member 125 may be removably attached to the blanket sheet 29.

In one embodiment, the sleeping bag 10 may further include a temperature sensing module (not shown) that may sense a temperature inside the first and second sleeping pockets by way of one or more temperature sensors. Based on the sensed temperature, the temperature sensor module may provide indication whether the sensed temperature in the first and second sleeping pockets is within predefined thresholds that are considered safe for the child sleeping in the first or second sleeping pockets. In one example, the temperature sensing module provides a visual or acoustic indication to a parent or care taker of the child.

Figure 5:
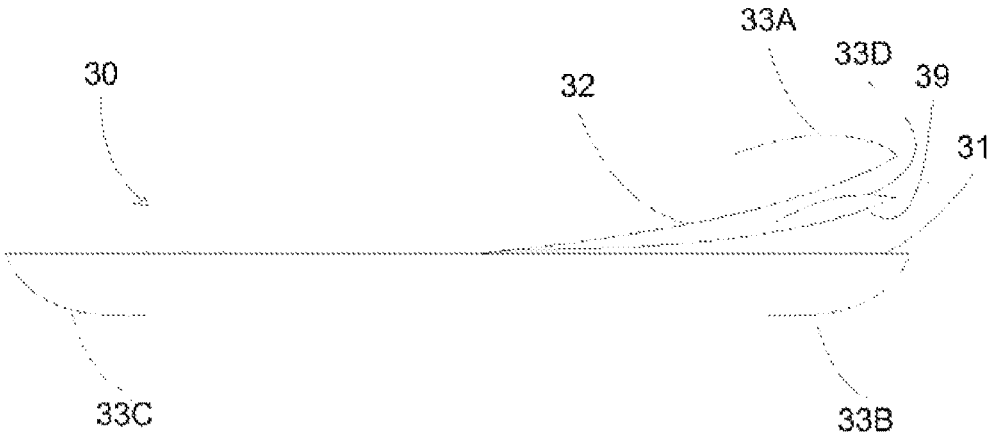
FIG. 5 illustrates another sleeping bag according to an embodiment of the present disclosure.

FIG. 5 illustrates another exemplary sleeping bag 30 according to an embodiment of the present disclosure. The sleeping bag 30 comprises a bed sheet 31, a blanket sheet 39, a cover sheet 32, and reversible pockets 33A, 33B, 33C, and 33D. The cover sheet 32 includes the reversible cover pocket 33A and the bed sheet 31 includes the reversible pad pockets 33B and 33C. The blanket sheet 39 is disposed between the cover sheet 32 and the bed sheet 31, and includes the reversible blanket pocket 33D. The reversible blanket pocket 33D may be made of the same blanket material, or may be made from a pocket panel having different type of fabric.

Figure 6:
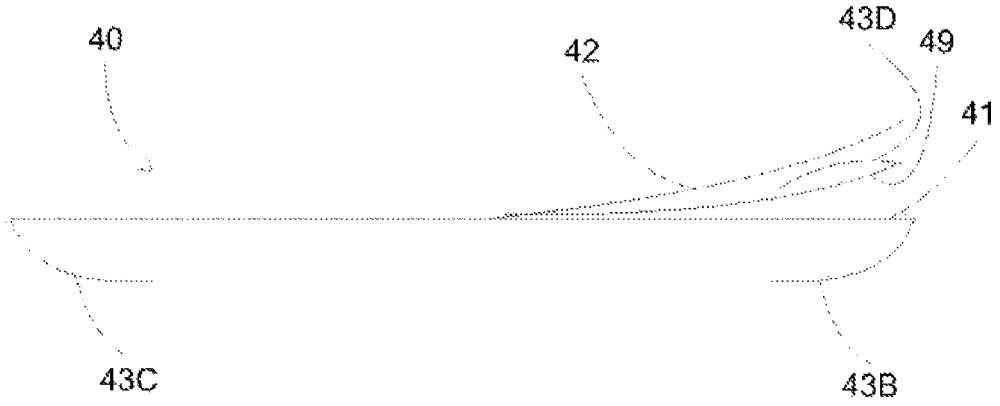
FIG. 6 illustrates another exemplary sleeping bag according to an embodiment of the present disclosure.

FIG. 6 illustrates another exemplary sleeping bag 40 according to an embodiment of the present disclosure. The sleeping bag 40 comprises a bed sheet 41, a blanket sheet 49, a cover sheet 42, and reversible pockets 43B, 43C, and 43D. The bed sheet 41 includes the reversible pad pockets 43B and 43C. The blanket sheet 49 is disposed between the cover sheet 42 and the bed sheet 41, and includes the reversible blanket pocket 43D. The cover sheet 42 is disposed outside the blanket sheet 49 and the bed sheet 41, and does not have any reversible pocket.

In an embodiment, the reversible pockets 43B, 43C, and 43D may have a stretchable section to vary the pocket opening. For example, the stretchable section on the reversible pad pockets 43B and 43C on the bed sheet 41 may accommodate different sizes of the pad.

Figure 7:
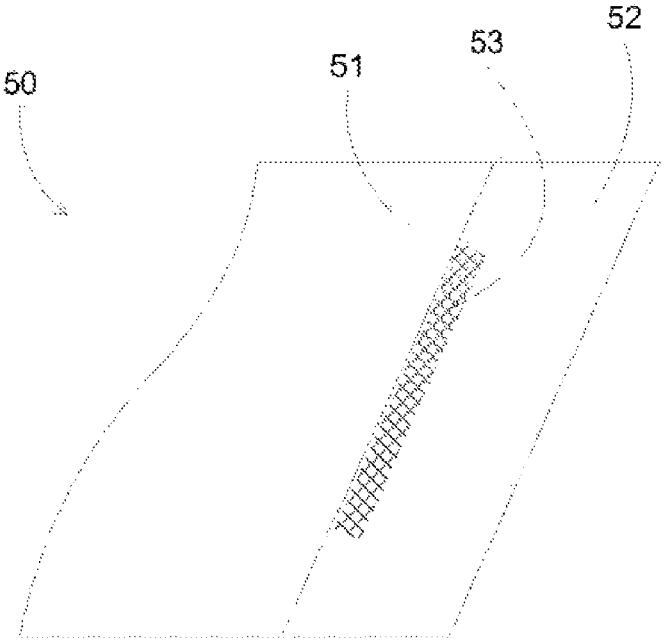
FIG. 7 illustrates an exemplary stretchable pocket on a sleeping bag according to an embodiment of the present disclosure.

FIG. 7 illustrates an exemplary stretchable pocket 52 on a sleeping bag 50 according to an embodiment of the present disclosure. The sleeping bag 50 has a sheet layer 51 with the stretchable pocket 52 at one end. A stretchable section 53 is disposed at the opening edge of the stretchable pocket 52. The stretchable section 53 may be formed by attaching a stretchable fabric to the stretchable pocket 52, or by folding the stretchable pocket 52 in a zigzag form. The stretchable section may also be formed with elastic bands or straps. The stretchable pocket 52 may be used on the pad pocket, on the cover pocket or on the blanket pocket.

In an embodiment, fastening devices such as, but not limited to, snap fasteners might be incorporated to provide additional attaching power. The fastening devices should be secured to the sleeping bag with no loose portions to avoid potential hazard to the children.

In an embodiment, the present disclosure discloses a sleeping bag for a crib (including bassinet, playpen or the like) or a portable crib to provide secure bedding, with a child safely and securely covered by the sleeping bag without loss of blanket cover due to movement. In an embodiment, the pad of the crib is lifted up, and the two pad pockets of the bed sheet cover the ends of the pad to securely attach the sleeping bag onto the pad. The pad, with the attached sleeping bag is then returned to the crib, providing a non-disturb able blanket for a child. Alternatively, the bed sheet can have different configurations for attachment to the pad or mattress of the crib, such as fitted sheet or corner pockets.

With the bed sheet of the sleeping bag secured to the pad, the sleeping bag is securely disposed on the surface of crib with the cover sheet and optionally the blanket sheet providing secure cover to the child for resting or sleeping. The present arrangement can provide secure blanket protection for a child, without concern about loss of blanket protection due to the movement of the child. After the child is safely tucked in the sleeping pocket of the sleeping bag, the child can freely move within the sleeping bag without exposing any part of the body to the outside environment. Further, a holding member may be removably attached to the sleeping bag to support the body of the child such that the child always is on the back while sleeping and is unable to completely slide inside the sleeping bad, thus avoiding any risk of SIDS or suffocation and providing extra safety to the child.

Figure 8:
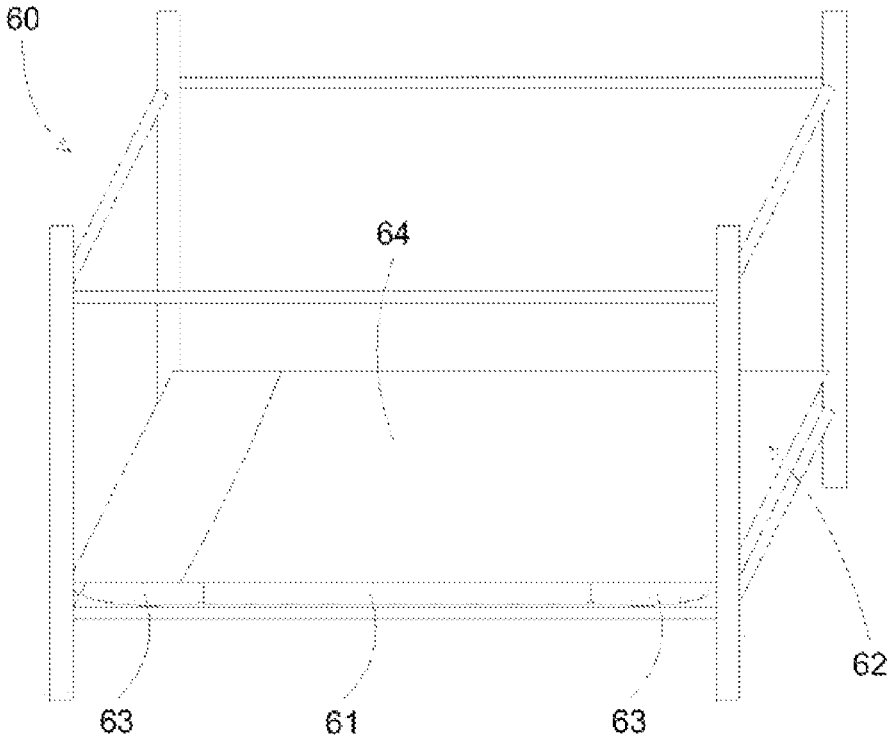
FIG. 8 illustrates a configuration of the present sleeping bag attached to a pad of a crib, according to an embodiment of the present disclosure.

FIG. 8 illustrates a configuration of the present sleeping bag attached to the pad of a crib, according to an embodiment of the present disclosure. A crib 60 has a pad 61 at the bottom surface of the crib 60. For portable crib, the pad is a thin layer, for example, made of foam material, for providing back support. For stationary crib, the pad is a thick mattress. A sleeping bag 62 is securely attached to the pad 61 through the pad pockets 63. A blanket and/or cover layer 64 is now securely fastened to the crib 60, providing a sleeping pocket for the child.

In an embodiment, the size of the sleeping bag 60 is designed to fit the standard size of a crib. The sleeping bag 60 may have stretchable pockets to accommodate different sizes of crib, or different types of pads, such as thin pads or thick mattresses. The sleeping bag 60 may further have securing pockets on an upper surface of the cover layer 64 that may be utilized to adjust a length of the sleeping bag 60 by folding the sleeping bag 60 and using one of the securing pockets along with one pad pocket to secures the sleeping bag 60 to the pad 61 in similar manner as described in FIGS. 3C-3E. In an embodiment, the sleeping bag 60 has no loose portions that might cover up or trap a child in a tight, dangerous situation.

Figure 9A:
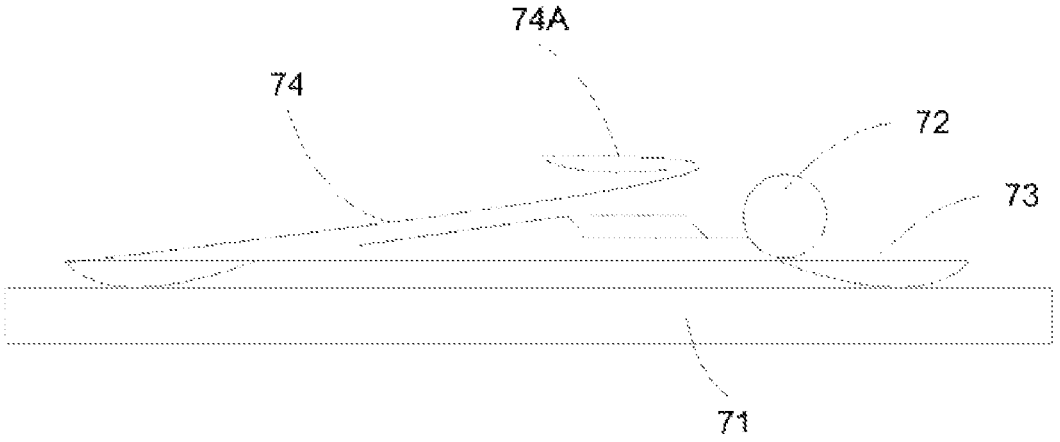
FIGS. 9A and 9B illustrate an exemplary embodiment where the sleeping bag is disposed on a surface.
Figure 9B:
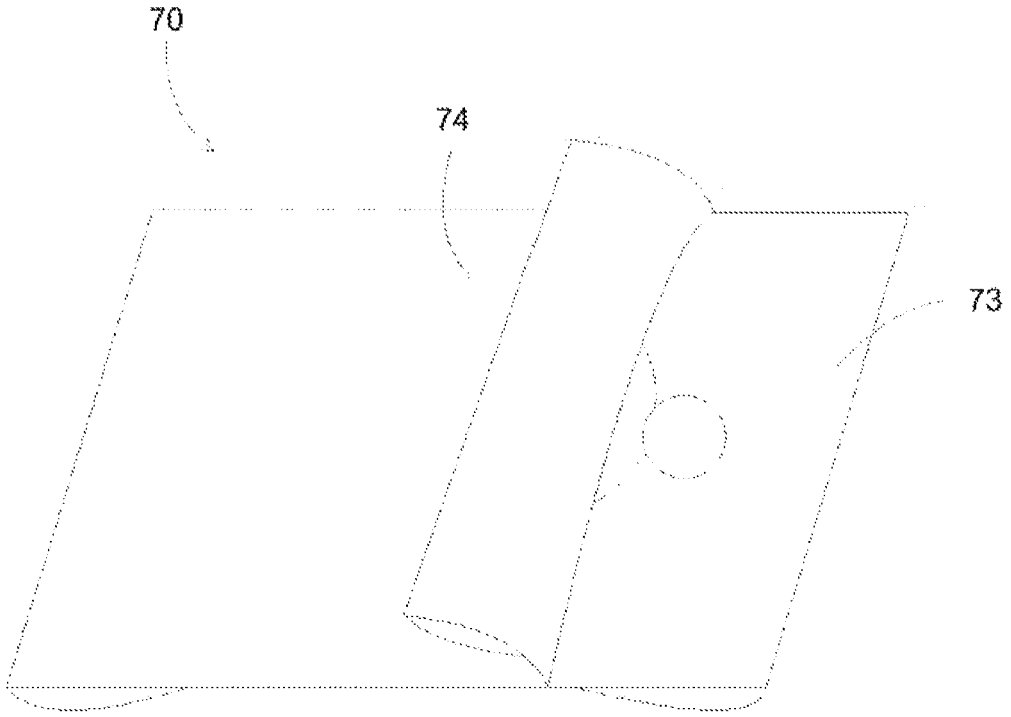

In an embodiment, the present disclosure discloses a multi-mode sleeping with safety and comfort for children. In a first mode, the sleeping bag is used as a sleeping bag, spreading on a surface with or without a pad, or spread on a crib with the pockets securely attached to the pad or mattress. FIGS. 9A and 9B illustrate an exemplary embodiment where a sleeping bag 70 is disposed on a surface 71. In this embodiment, the present sleeping bag 70 is used as a conventional sleeping bag, where a child 72 can be safely and securely sleeping within the sleeping pocket. As shown, the sleeping bag 70 comprises a bed sheet 73 and a cover sheet (or blanket sheet) 74. Alternatively, the sleeping bag 70 may comprise a bed sheet, a blanket sheet and a cover sheet. Additional sheet might also be incorporated. The cover sheet 74 also shows a portion 74A folded over the cover sheet. Optional snap buttons or other attachment mechanisms can be included for holding the cover sheet 74 away from the child 72. Alternatively, in an embodiment, the cover sheet 74 is shorter than the bed sheet 73, without the folded portion 74A.

Figure 9C:
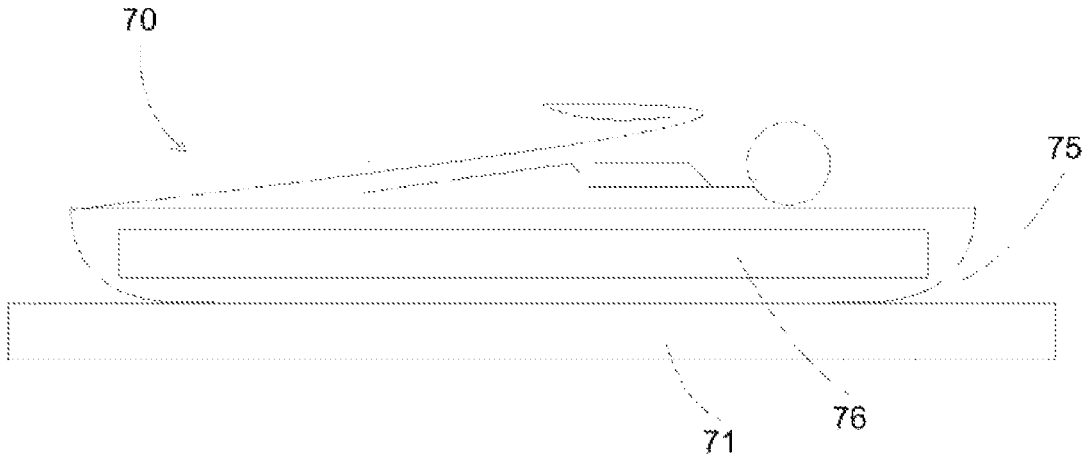
FIG. 9C illustrates an exemplary embodiment where the sleeping bag is disposed on a pad on a surface.

FIG. 9C illustrates an exemplary embodiment where the sleeping bag 70 is disposed on a pad 76 on the surface 71, for example, to provide additional support. The pad 76 is tucked in pockets 75 of the bed sheet 73, to securely attach the sleeping bag 70 to the pad 76. In this embodiment, the present sleeping bag 70 is also used as a conventional sleeping bag with the pad providing an intermediate cushion on the surface 71. For example, the surface 71 can be a hard surface, and the pad 76 can provide a softer surface for the sleeping bag 70. Alternatively, the surface 71 can be a soft surface, and the pad 76 can provide a harder surface for the sleeping bag 70.

Figure 9D:
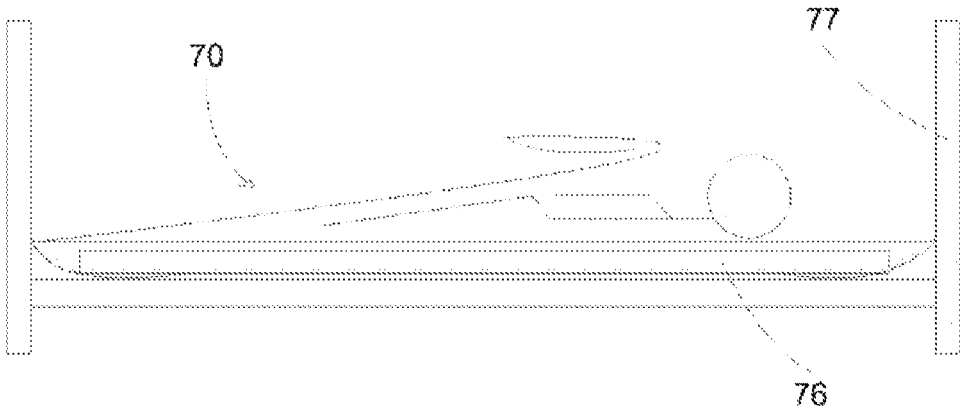
FIG. 9D illustrates an exemplary embodiment where the sleeping bag is disposed on a thin pad in a crib.

FIG. 9D illustrates an exemplary embodiment where the sleeping bag 70 is disposed on a thin pad 76 in a crib 77, such as a portable crib. The pad 76 is tucked in the pockets 75 of the bed sheet 73, to securely attach the sleeping bag 70 to the pad 76, to provide a sleeping environment where the cover (or blanket) 74 is not disturbed by movement of the child. Further, if the holding member 120 or 125 is attached to the sleeping bag the child will be provided extra support such that the child is always on the back while sleeping. In this embodiment, the present sleeping bag 70 is also used as a portable blanket with bed sheet for a crib. The portability of the present sleeping bag can provide additional sanitation in public places, such as a daycare center. For each child, the used sleeping bag is taken away and a new sleeping bag is attached.

Figure 9E:
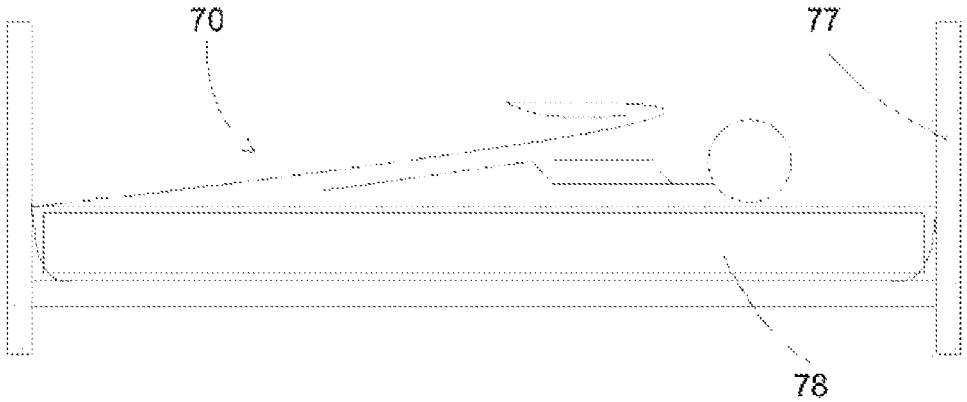
FIG. 9E illustrates an exemplary embodiment where the sleeping bag is disposed on a thick mattress in a crib.

FIG. 9E illustrates an exemplary embodiment where the sleeping bag 70 is disposed on a thick mattress 78 in a crib 79, such as a stationary crib. Stretchable pockets of the bed sheet 73 may be used to accommodate the sleeping bag 70 with the thin pad 76 or the thick mattress 78.

Figure 10A:
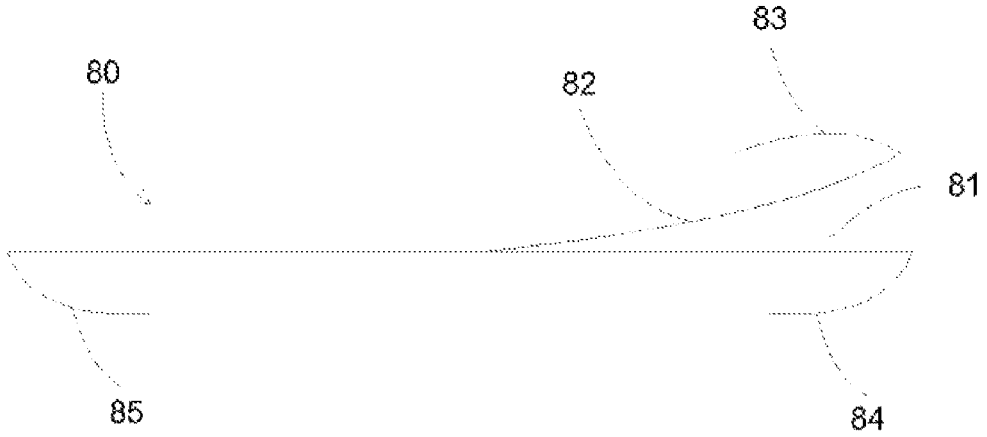
FIGS. 10A-10C illustrate a process for setting the sleeping bag into a one-piece component.
Figure 10B:
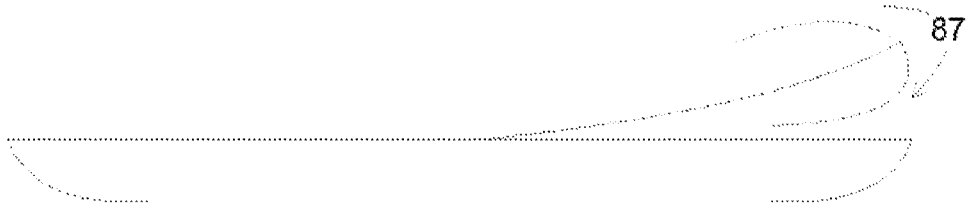
Figure 10C:
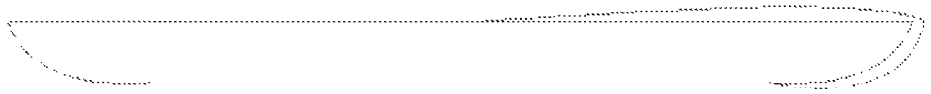

In a second mode, the present sleeping bag can be tucked together to be used as a one-piece mat or blanket, with or without a pad. FIG. 10 illustrates a process for setting a sleeping bag 80 into a one-piece component. As shown in FIG. 10A, the sleeping bag 80 comprises a bed sheet 81 having pockets 84 and 85, and a cover sheet 82 having a reversible pocket 83. In FIG. 10B, the reversible pocket 83 of the cover sheet 82 is reversed 87. In FIG. 8C, the reversed pocket 83 covers the pocket 84 of the bed sheet 81 at the same end to form a one-piece component without any loose portions. FIG. 10 illustrates the sleeping bag 80 with two sheets 81 and 82, but more than two sheets may be used, such as an optional blanket sheet, disposed on the cover sheet 82 or between the cover sheet 82 and the bed sheet 81.

Figure 11A:
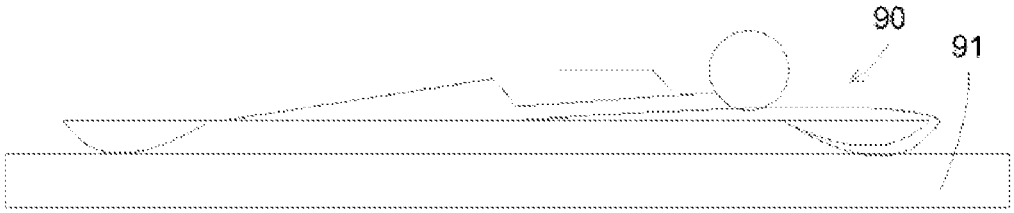
FIG. 11A illustrates a tucked one-piece sleeping bag disposed on a surface as a mattress.
Figure 11B:
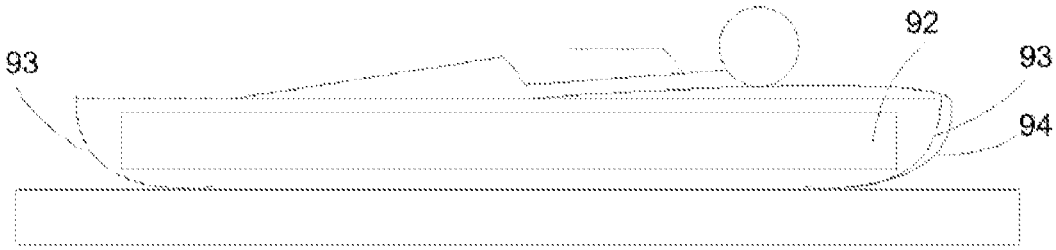
FIG. 11B illustrates a tucked one-piece sleeping bag attached to a pad on a surface as a mattress.
Figure 11C:
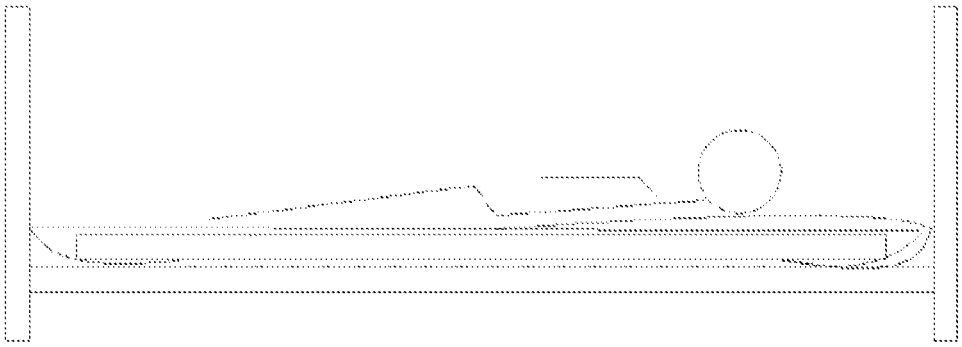
FIG. 11C illustrates a tucked one-piece sleeping bag attached to a pad in a crib functioning as a mattress.
Figure 11D:
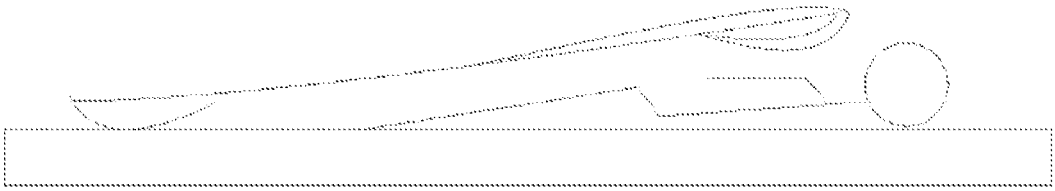
FIG. 11D illustrates a tucked one-piece sleeping bag used as blanket.

After being tucked together, the sleeping bag 80 may be used as a one-piece mattress, to be rested or slept on. In addition, the one-piece mattress has no loose portion, since the cover sheet 82 has been tucked to the bed sheet 81. FIG. 11A illustrates a tucked one-piece sleeping bag 90 disposed on a surface 91 as a mattress. The surface 91 can be the resting surface of a crib, where the sleeping bag 90 is laid on top of the crib for a child to rest or sleep. FIG. 11B illustrates the tucked one-piece sleeping bag 90 attached to a pad 92 on a surface 91 as a mattress. The bed sheet includes two pockets 93, one on each side. One of the pockets 93 at one end of the bed sheet covers one end of the pad 92. The pockets 93 (at another end of the bed sheet) and 94 (at the same end of the cover sheet) cover the other end of the pad 92. The mattress is resting on a surface, such as a floor surface, or the resting surface of a crib, functioning as a mattress. For example, in a warm day, the sleeping bag 90 may be converted to a mattress for a child to play, rest or sleep on. The converted sleeping bag 90 presents a solid surface to the child, thus preventing any potential hazard when a young child is staying on it, for example, the hazard associated with the sleeping bag, such as loose flap at one end or a sleeping pocket. Alternatively, the one-piece sleeping bag can be used as a blanket instead of a mattress. FIG. 11C illustrates a tucked one-piece sleeping bag attached to a pad in a crib as a mattress. FIG. 11D illustrates a tucked one-piece sleeping bag used as blanket, for example, for a child.

Figure 12A:
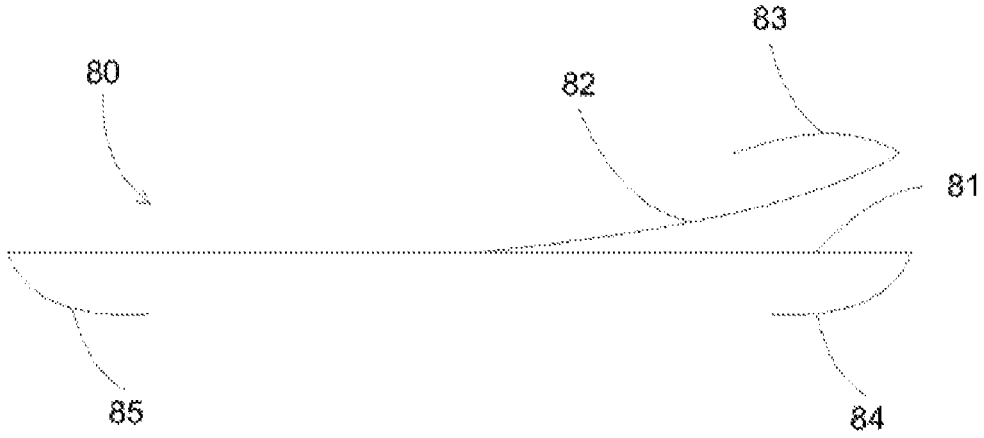
FIGS. 12A-12C illustrate a process for folding the sleeping bag.
Figure 12B:
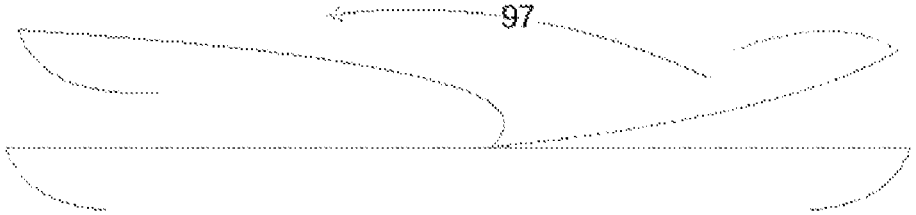
Figure 12C:
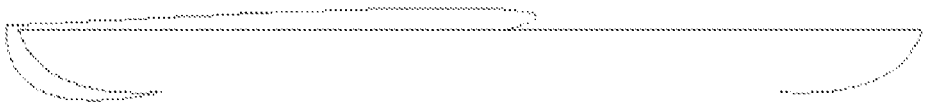

In a third mode, the present sleeping bag can be partially folded to be used either as a sleeping bag or as a one-piece mat or blanket, with or without a pad. FIGS. 12A-12C illustrate a process for folding the sleeping bag 80. As shown in FIG. 12A, the sleeping bag 80 comprises the bed sheet 81 having the pockets 84 and 85, and the cover sheet 82 having the reversible pocket 83. In FIG. 12B, the cover sheet 82 is folded 97 to the pocket end 85. In FIG. 12C, the pocket 83 of the folded cover sheet covers the pocket 85 to form a sleeping bag or a one-piece component without any loose portions. FIGS. 12A-12C illustrate the sleeping bag 80 with two sheets 81 and 82, but more than two sheets can be used, such as an optional blanket sheet, disposed on the cover sheet 82 or between the cover sheet 82 and the bed sheet 81. The blanket sheet may also be folded together with the cover sheet 82 to cover the same pocket end 85. Alternatively, the blanket sheet may stay extended and the pocket reversed to cover the pocket end 84.

Figure 13A:
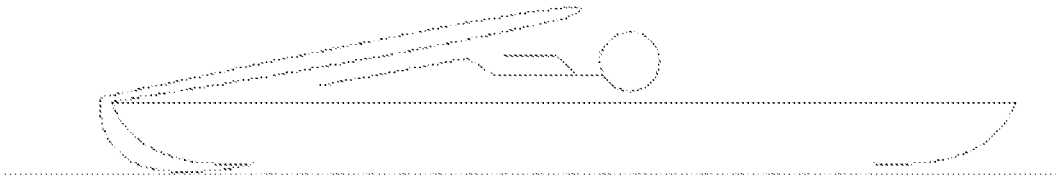
FIG. 13A illustrates a configuration for the folded sleeping bag to function as a sleeping bag.
Figure 13B:
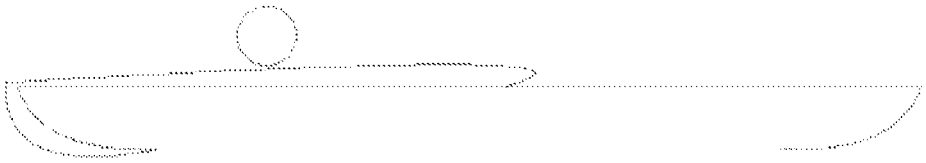
FIGS. 13B and 13C illustrate different configurations for the folded sleeping bag to function as a mattress.
Figure 13C:
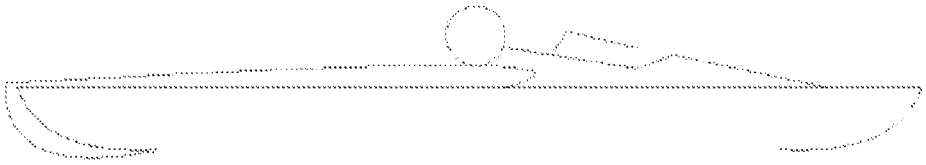

After a partial fold, the sleeping assembly can be used as a sleeping bag, since the cover sheet is folded over to expose the sleeping pocket. FIG. 13A illustrates a configuration for the folded sleeping bag to function as a sleeping bag. The cover sheet is folded over, and tucked to one pocket of the bed sheet. A child can sleep or rest in the sleeping pocket. As shown, the sleeping bag is positioned on a surface without attaching to a pad. Alternatively, the sleeping bag can be attached to a pad, and then positioned on a surface or in a crib. FIGS. 13B and 13C illustrate different configurations for the folded sleeping bag to function as a mattress. As shown, the sleeping bag is positioned on a surface without a pad, but alternatively, a pad can be attached to the bed pockets. A small child can lie on half of the sleeping bag (FIG. 13B), or a bigger child can lie on the whole sleeping bag. In another embodiment, the folded sleeping bag can function as a blanket.

Figure 14A:
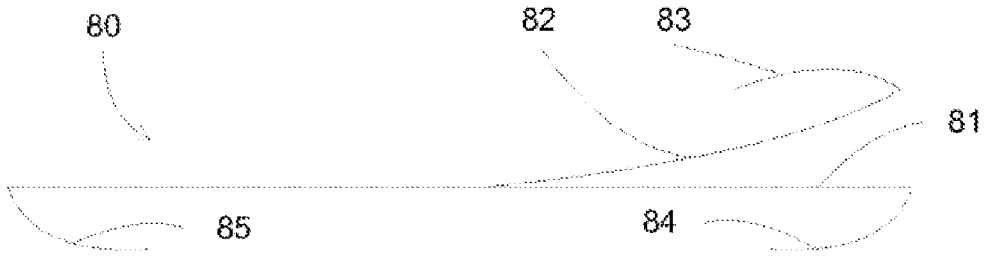
FIGS. 14A-14E illustrate a process for folding the sleeping bag.
Figure 14B:
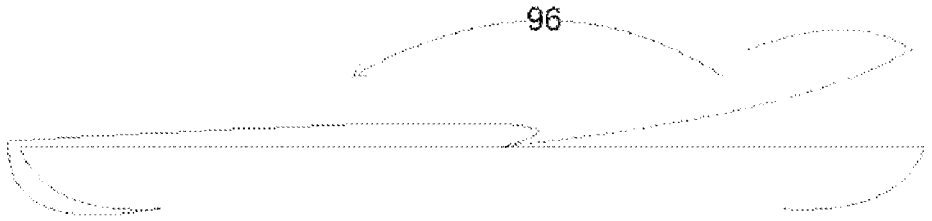
Figure 14C:
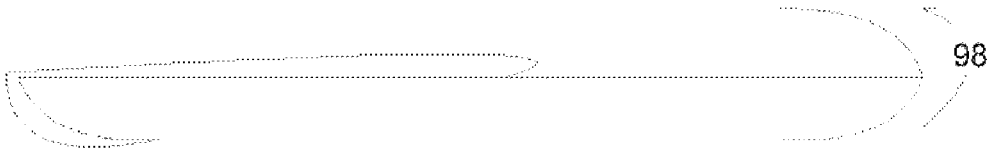
Figure 14D:
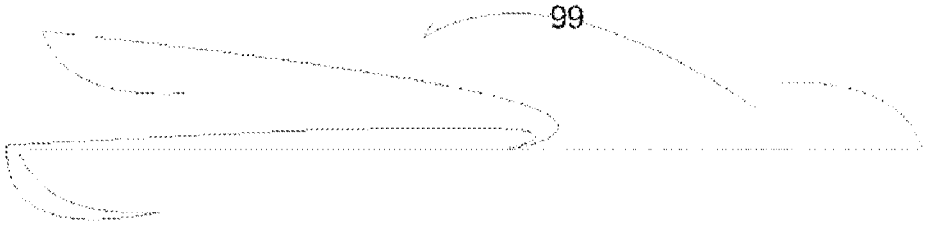
Figure 14E:
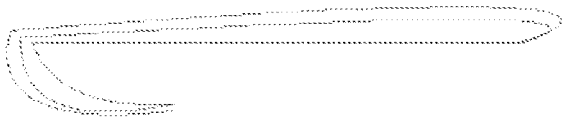
Figure 15A:
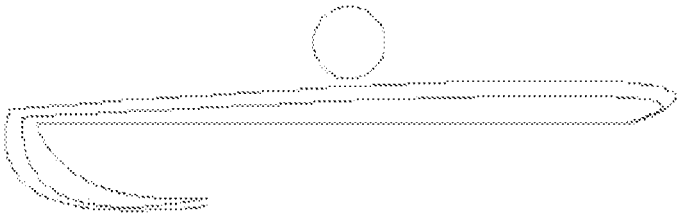
FIG. 15A-15B illustrate a configuration for the folded sleeping bag to function as a half-size mattress.
Figure 15B:
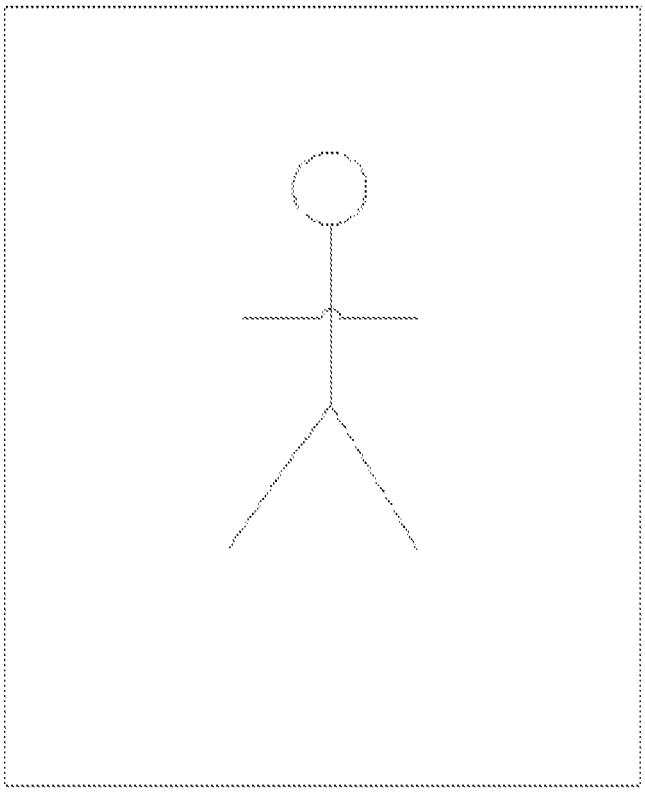

In a fourth mode, the present sleeping bag can be partially folded to be used as a half-size mat or blanket, for example, a changing pad on a hard surface for infants and small children. FIGS. 14A-14E illustrate a process for folding the sleeping bag 80. As shown in FIG. 14A, the sleeping bag 80 comprises the bed sheet 81 having the pockets 84 and 85, and the cover sheet 82 having the reversible pocket 83. In FIG. 14B, the cover sheet 82 is folded 96 towards the pocket 85 of the bed sheet 81. The reversible pocket 83 of the cover sheet 82 covers the pocket 85 of the bed sheet 81. In FIG. 14C, the pocket 84 of the bed sheet 81 is reversed 98. In FIG. 12D, the bed sheet 81 is folded 99 to the pocket end 85. In FIG. 12E, the reversed pocket 84 of the bed sheet 81 covers the pocket 85 and the reversible pocket 83 to form a half-size mattress or blanket without any loose portions. FIG. 14A-14E illustrate the sleeping bag 80 with two sheets 81 and 82, but more than two sheets can be used, such as an optional blanket sheet, disposed on the cover sheet 82 or between the cover sheet 82 and the bed sheet 81. FIGS. 15A and 15B illustrate a configuration for the folded sleeping bag to function as a half-size mattress.

Figure 16:
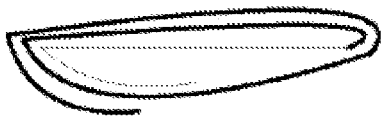
FIG. 16 illustrates a configuration for the doubly folded sleeping bag.

In a fifth mode, the present sleeping bag can be doubly folded for storage. FIG. 16 illustrates a configuration for the doubly folded sleeping bag. For example, when not in use, the entire sleeping bag may be rolled, folded, and tucked into a compact shape for storage. The doubly folded sleeping bag can be used as a pillow.

Figure 17:
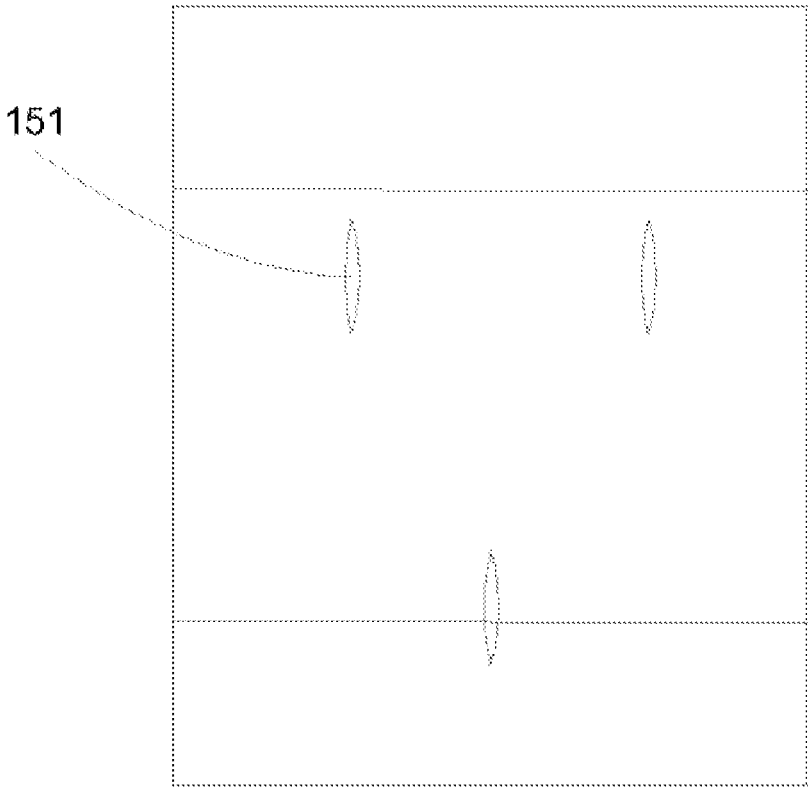
FIG. 17 illustrates an exemplary sleeping bag comprising slits to accommodate seat belts or stroller harness.
Figure 18:
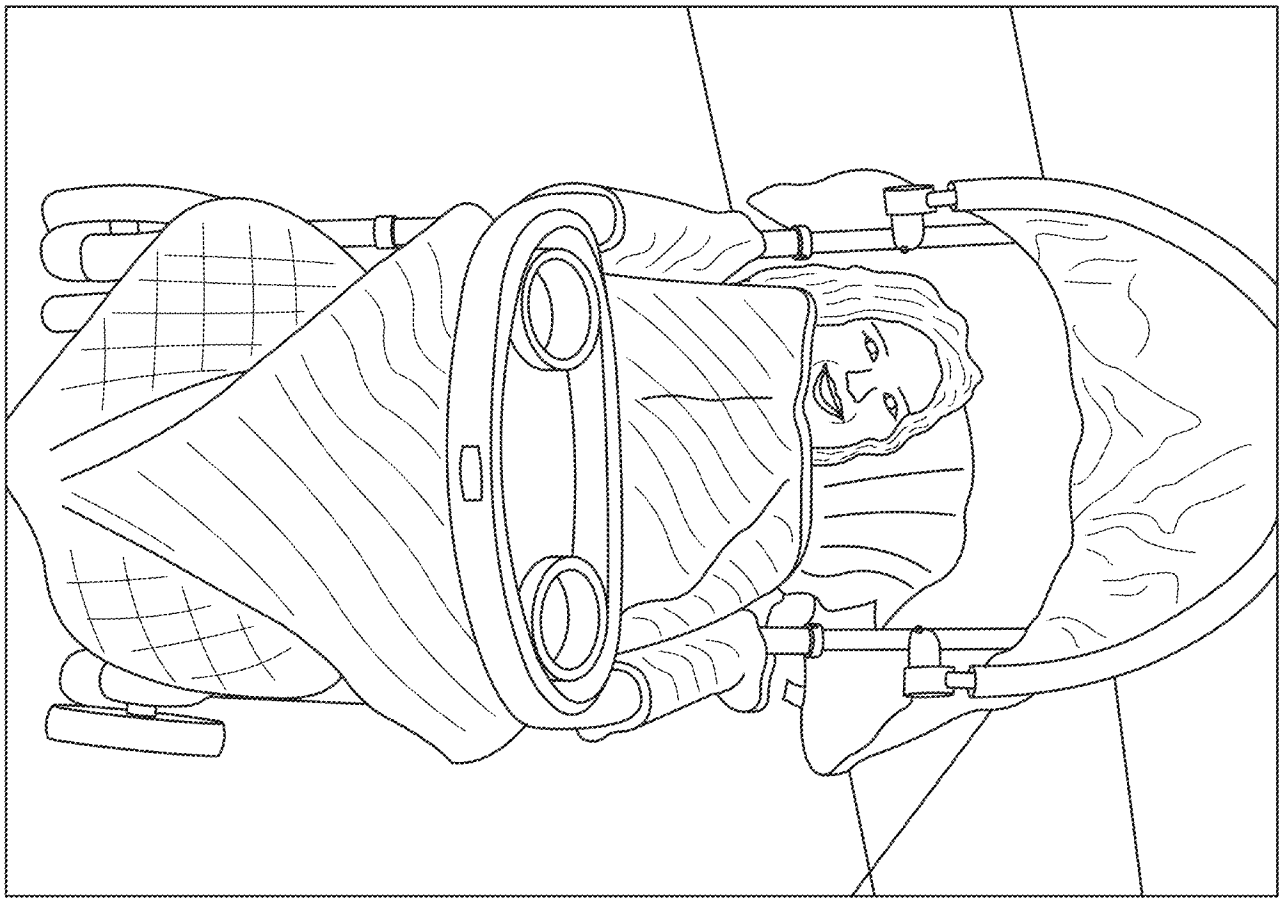
FIG. 18 illustrates an exemplary configuration having a sleeping bag used as a blanket for a stroller.

In an embodiment, the present sleeping bag can be used as a portable and removable blanket with a movable object, for example, a stroller or car seat. The sleeping bag may comprise a number of slits for securing to a support, i.e., a harness of the stroller or the car seat. FIG. 17 illustrates an exemplary sleeping bag comprising slits 151 to accommodate seat belts or stroller harness. The slits may have cover, for example, to seal the opening with Velcro or fastening buttons. FIG. 18 illustrates an exemplary configuration having a sleeping bag used as a blanket for a stroller. The lower portion of the stroller seat can be tucked to a bed sheet pocket. The stroller harness slides through the sleeping bag slits and locked with mated harness locking mechanism.

While the disclosure has been described and illustrated in connection with preferred embodiments, many variations and modifications, as will be apparent to those of skill in the art, may be made without departing from the spirit and scope of the disclosure. The disclosure as set forth in the appended claims is thus not limited to the precise details of construction set forth above as such variations and modifications are intended to be included within the spirit and scope of the disclosure as set forth in the defined claims.

Although the disclosure is described herein with reference to specific embodiments, various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

The term "coupled", as used herein, is not intended to be limited to a direct coupling or a mechanical coupling.

Unless stated otherwise, terms such as "first" and "second" are used to arbitrarily distinguish between the elements such terms describe. Thus, these terms are not necessarily intended to indicate temporal or other prioritization of such elements.

Unless otherwise stated, conditional languages such as "can", "could", "will", "might", or "may" are understood within the context as used in general to convey that certain embodiments include, while other embodiments do not include, certain features and/or elements. Thus, such conditional languages are not generally intended to imply that features and/or elements are in any way required for one or more embodiments.

It will be understood by those within the art that, in general, terms used herein, are generally intended as "open" terms (e.g., the term "including" should be interpreted as "including but not limited to", the term "having" should be interpreted as "having at least", the term "includes" should be interpreted as "includes but is not limited to", etc.).

What is claimed is:

1. A sleeping bag, comprising:

a bed sheet, a blanket sheet, and a cover sheet attached to each other at a first end and a portion of two sides adjacent to the first end, and freed at a second end opposite to the first end to form a first sleeping pocket between the bed sheet and the blanket sheet and a second sleeping pocket between the blanket sheet and the cover sheet, wherein:

the first and second sleeping pockets have similar configurations, the bed sheet comprises at least one of a plurality of reversible pockets and a set of slits for securing the sleeping bag to a support, the plurality of reversible pockets include first and second reversible pockets attached at the first and second ends of the bed sheet, respectively, the cover sheet comprises a third reversible pocket at the second end, and the blanket sheet comprises a fourth reversible pocket at the second end; and a first holding member removably attached to the bed sheet and the second end of one of the blanket sheet and the cover sheet, wherein the holding member forms openings for a head and hands of a child sleeping in one of the first and second sleeping pockets, so that a body of the child below the shoulders is covered by one of the first and second sleeping pockets and the first holding member does not contact a back of the child, wherein the first holding member is configured to securely support shoulders of the child to prevent the child from sleeping on their side or stomach such that the child is on their back while sleeping and the child is unable to slide their entire body inside one of the first and second sleeping pockets, wherein the first holding member comprises first and second hand covers to receive hands of the child sleeping in one of the first and second sleeping pockets; and further comprising a second holding member removably attached to the bed sheet, the second holding member being separate from the first holding member, a first end of the second holding member forming openings for legs of the child and a second end of the second holding member forming an opening for an upper body of the child sleeping in the first sleeping pocket, so as to securely support a lower body of the child such that the child is always on the back while sleeping and the child is prevented from rolling onto their side or stomach and unable to slide their entire body inside the first sleeping pocket.

2. The sleeping bag of claim 1, wherein an upper surface of the cover sheet comprises a set of securing pockets, wherein the set of securing pockets enable a length of the sleeping bag to be adjusted by folding the sleeping bag from the first end at a securing pocket of the set of securing pockets, and securing the sleeping bag to the support by way of the securing pocket instead of the second reversible pocket.

3. The sleeping bag of claim 1, wherein the third and fourth reversible pockets have substantially similar dimensions as the second reversible pocket to allow overlapping of the second reversible pocket by at least one of the third and fourth reversible pocket in a reversible configuration to secure at least one of the cover sheet and the blanket sheet to the bed sheet.

4. The sleeping bag of claim 1, wherein the cover sheet comprises a quilted sheet.

5. The sleeping bag of claim 1, wherein when the support is a support pad of a crib, the sleeping bag is secured to the support pad by way of the plurality of reversible pockets.

6. The sleeping bag of claim 1, wherein when the support is a harness of a movable object, the sleeping bag is secured to the harness by way of the set of slits.

7. A sleeping bag, comprising:

a bed sheet, a blanket sheet, and a cover sheet attached to each other at a first end and a portion of two sides adjacent to the first end, and freed at a second end opposite to the first end to form a first sleeping pocket between the bed sheet and the blanket sheet and a second sleeping pocket between the blanket sheet and the cover sheet, wherein:

the first and second sleeping pockets have similar configurations, the bed sheet comprises a plurality of reversible pockets for securing the sleeping bag to a support, the plurality of reversible pockets include first and second reversible pockets attached at the first and second ends of the bed sheet, respectively, the cover sheet comprises a third reversible pocket at the second end, and the blanket sheet comprises a fourth reversible pocket at the second end;

wherein an upper surface of the cover sheet comprises a set of securing pockets, the set of securing pockets enabling a length of the sleeping bag to be adjusted by folding the sleeping bag from the first end at a securing pocket of the set of securing pockets, and securing the sleeping bag to the support by way of the securing pocket instead of by way of the second reversible pocket.

8. The sleeping bag of claim 7, wherein the third and fourth reversible pockets have substantially similar dimensions as the second reversible pocket to allow overlapping of the second reversible pocket by at least one of the third and fourth reversible pocket in a reversible configuration to secure at least one of the cover sheet and the blanket sheet to the bed sheet.

9. The sleeping bag of claim 7, wherein the cover sheet comprises a quilted sheet.

10. The sleeping bag of claim 7, wherein the support is a support pad of a crib, and the sleeping bag is secured to the support pad by way of the plurality of reversible pockets.

11. The sleeping bag of claim 7, wherein the support is a harness of a movable object, the bed sheet comprises a set of slits and the sleeping bag is secured to the harness by way of the set of slits.

12. The sleeping bag of claim 7, wherein the set of securing pockets on the upper side of the cover sheet comprises a first securing pocket and a second securing pocket and wherein the length of the sleeping bag is adjustable between a first length, a second length and a third length by one of: securing the sleeping bag to the support by the second reversible pocket, folding the sleeping bag at the first securing pocket and securing to the support by the first securing pocket, or folding the sleeping bag at the second securing pocket and securing to the support by the second securing pocket.

13. A multi-mode sleeping bag, comprising:

at least a bed sheet and a cover sheet attached to each other at a first end and a portion of two sides adjacent to the first end, and freed at a second end opposite to the first end to form a first sleeping pocket between the bed sheet and the cover sheet, wherein:

the bed sheet comprises first and second reversible pockets at the first and second ends, respectively, and the cover sheet comprising a third reversible pocket at the second end that has substantially similar dimensions as the second reversible pocket to allow overlapping of the second reversible pocket by the third reversible pocket in a reversible configuration to secure the cover sheet to the bed sheet, the multi-mode sleeping bag is configured to comprise:

a first mode having the multi-mode sleeping bag spreading on a surface, functioning as a sleeping bag, a second mode having the third reversible pocket of the cover sheet covering the second reversible pocket of the bed sheet at the second end, functioning as a mattress or a blanket with no loose flap, a third mode having the cover sheet folded over and the third reversible pocket of the cover sheet at the first end covering the first reversible pocket of the bed sheet at the first end, functioning as a sleeping bag, a mattress or a blanket with no loose flap, a fourth mode having the bed sheet and the cover sheet folded over and the second and third reversible pockets of the bed sheet and the cover sheet at the second end, respectively, covering the first reversible pocket of the bed sheet at the first end, functioning as a mattress with no loose flap, and a fifth mode having the bed sheet and the cover sheet folded twice over and the second and third reversible pockets of the bed sheet and the cover sheet at the second end, respectively, covering the first reversible pocket of the bed sheet at the first end, readying for storage; and a holding member attached to at least one of the bed sheet and the cover sheet to securely hold a child sleeping in the first sleeping pocket such that the child is on the back while sleeping and is prevented from rolling onto the side or stomach and prevented from sliding their entire body inside the first sleeping pocket, wherein the holding member does not cover the back or chest of the child and comprises first and second hand covers to receive hands of the child sleeping in one of the first and second sleeping pockets.

14. The multi-mode sleeping bag of claim 13, wherein the multi-mode sleeping bag is configured to further comprise a sixth mode for functioning as a blanket for a movable object with a secured harness.

15. The multi-mode sleeping bag of claim 13, wherein the holding member is removably attached to the bed sheet and the cover sheet, and wherein the holding member forms openings for a head and hands of the child sleeping in the first sleeping pocket, to support shoulders of the child such that the child is on the back while sleeping and the child is unable to slide entire body inside the first sleeping pocket.

16. The multi-mode sleeping bag of claim 13, wherein the holding member is removably attached to the bed sheet, wherein the holding member forms openings for upper body and legs of the child sleeping in the first sleeping pocket, to support a lower body of the child such that the child is on the back while sleeping and the child is unable to slide entire body inside the first sleeping pocket.

17. The sleeping bag of claim 13, wherein the bed sheet comprises the first and second reversible pockets and a set of slits for securing the sleeping bag to a support.

18. The sleeping bag of claim 17, wherein an upper surface of the cover sheet comprises a set of securing pockets, the set of securing pockets enabling a length of the sleeping bag to be adjusted by folding the sleeping bag from the first end at a securing pocket of the set of securing pockets, and securing the sleeping bag to the support by way of said securing pocket instead of the second reversible pocket.

19. The sleeping bag of claim 13, wherein the holding member is a single piece of material that is removably attached to the bed sheet and the second end of the cover sheet so as to cover shoulders and arms of the child without covering the back or main body of the child.

20. The sleeping bag of claim 19, further comprising a further holding member removably attached to the bed sheet, wherein the further holding member forms openings for upper body and legs of the child sleeping in the first sleeping pocket, to support a lower body of the child such that the child is on the back while sleeping and the child is unable to slide entire body inside the first sleeping pocket.

* * * * *